US009633611B2

(12) United States Patent
Inoue

(10) Patent No.: US 9,633,611 B2
(45) Date of Patent: Apr. 25, 2017

(54) READINESS SIGNALING BETWEEN MASTER AND SLAVE CONTROLLERS OF A LIQUID CRYSTAL DISPLAY

(75) Inventor: Akihiko Inoue, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 52 days.

(21) Appl. No.: 14/117,902

(22) PCT Filed: May 17, 2012

(86) PCT No.: PCT/JP2012/062707

§ 371 (c)(1),
(2), (4) Date: Nov. 15, 2013

(87) PCT Pub. No.: WO2012/157722

PCT Pub. Date: Nov. 22, 2012

(65) Prior Publication Data

US 2014/0085174 A1 Mar. 27, 2014

(30) Foreign Application Priority Data

May 18, 2011 (JP) ..... 2011-111905

(51) Int. Cl.

| | |
|---|---|
| ***G09G 3/36*** | (2006.01) |
| ***G09G 3/20*** | (2006.01) |
| *G09G 3/34* | (2006.01) |

(52) U.S. Cl.

CPC ..... *G09G 3/36* (2013.01); *G09G 3/2074* (2013.01); *G09G 3/3655* (2013.01); (Continued)

(58) Field of Classification Search

CPC ..... G09G 3/36; G09G 2360/06; G09G 2300/026; G06F 3/1423–3/1446 (Continued)

(56) References Cited

U.S. PATENT DOCUMENTS

2002/0118200 A1* 8/2002 Mukherjee ..... G06F 3/1438 345/504
2004/0013214 A1 1/2004 Katta et al.
(Continued)

FOREIGN PATENT DOCUMENTS

JP 11-15451 1/1999
JP 3076272 B2 8/2000
(Continued)

OTHER PUBLICATIONS

International Search Report dated Jun. 12, 2012 for Application No. PCT/JP2012/062707.

*Primary Examiner* — Amare Mengistu
*Assistant Examiner* — Sarvesh J Nadkarni
(74) *Attorney, Agent, or Firm* — Harness, Dickey & Pierce, P.L.C.

(57) ABSTRACT

A liquid crystal display includes a liquid crystal panel and a first to nth control substrates (n is an integer which is 2 or greater) which control the liquid crystal panel. When the first control substrate enters an operable status, the first control substrate transmits a readiness signal to the second control substrate which is at a next stage, and when the nth control substrate determines that the nth control substrate receives a readiness signal from a control substrate at a previous stage and is in an operable status, the nth control substrate transmits a readiness signal to the first control substrate, thereby being able to suppress a synchronization failure between the plurality of control substrates which are provided in a liquid crystal display.

9 Claims, 14 Drawing Sheets

(52) U.S. Cl.
CPC ..... *G09G 3/3659* (2013.01); *G09G 3/3666* (2013.01); *G09G 3/3426* (2013.01); *G09G 3/3614* (2013.01); *G09G 2300/026* (2013.01); *G09G 2300/0809* (2013.01); *G09G 2300/0876* (2013.01); *G09G 2320/0646* (2013.01); *G09G 2330/021* (2013.01); *G09G 2360/06* (2013.01)

(58) Field of Classification Search
USPC ..... 345/1.1–3.4
See application file for complete search history.

(56) References Cited

U.S. PATENT DOCUMENTS

| | | | | |
|---|---|---|---|---|
| 2004/0028145 | A1 | 2/2004 | Katta et al. | |
| 2004/0042542 | A1 | 3/2004 | Kawada et al. | |
| 2004/0042555 | A1 | 3/2004 | Kawada et al. | |
| 2004/0088436 | A1 | 5/2004 | Katta et al. | |
| 2010/0302214 | A1* | 12/2010 | Kim | G09G 3/20 345/204 |
| 2011/0242412 | A1* | 10/2011 | Lee et al. | 348/500 |
| 2011/0248966 | A1* | 10/2011 | Ahn | G09G 3/3611 345/204 |
| 2011/0273424 | A1* | 11/2011 | Hwang et al. | 345/211 |

FOREIGN PATENT DOCUMENTS

| | | | |
|---|---|---|---|
| JP | 2009-186502 | A | 8/2009 |
| WO | WO-02/30079 | A1 | 4/2002 |

* cited by examiner

READINESS SIGNALING BETWEEN MASTER AND SLAVE CONTROLLERS OF A LIQUID CRYSTAL DISPLAY

TECHNICAL FIELD

The present invention relates to a technology that a plurality of controllers are provided in a display apparatus.

BACKGROUND ART

In general, PTL 1 discloses a technology that a plurality of controllers are provided in a display apparatus and the controllers are operated in synchronization (in parallel) with each other.

CITATION LIST

Patent Literature

PTL 1: Japanese Patent No. 3076272

SUMMARY OF INVENTION

Technical Problem

There is a problem in that electrical power required by each controller increases due to high-definition and a high-speed driving of a liquid crystal display, and, for example, when the controllers start up after a power supply is turned on, a synchronization between the controllers is disturbed to cause a malfunction of display due to a variation between the controllers in electric power supply state.

An object of the present invention is to suppress a synchronization failure between a plurality of controllers that are provided in a display apparatus.

Solution to Problem

A present invention provides a liquid crystal display including a liquid crystal panel and a first to nth control substrates (n is an integer which is 2 or greater) which control the liquid crystal panel. When the first control substrate enters an operable status, the first control substrate transmits a readiness signal to the second control substrate which is at a next stage, and when the nth control substrate determines that the nth control substrate receives a readiness signal from a control substrate at a previous stage and is in an operable status, the nth control substrate transmits a readiness signal to the first control substrate.

According to the liquid crystal display, the first control substrate (master) can recognize that other control substrates (slaves) are in readiness, thereby being able to suppress a synchronization failure between the plurality of control substrates which are provided in a liquid crystal display.

Advantageous Effects of Invention

The configuration can suppress a synchronization failure between the plurality of control substrates which are provided in a liquid crystal display.

DESCRIPTION OF EMBODIMENTS

Example 1

Figure 2:
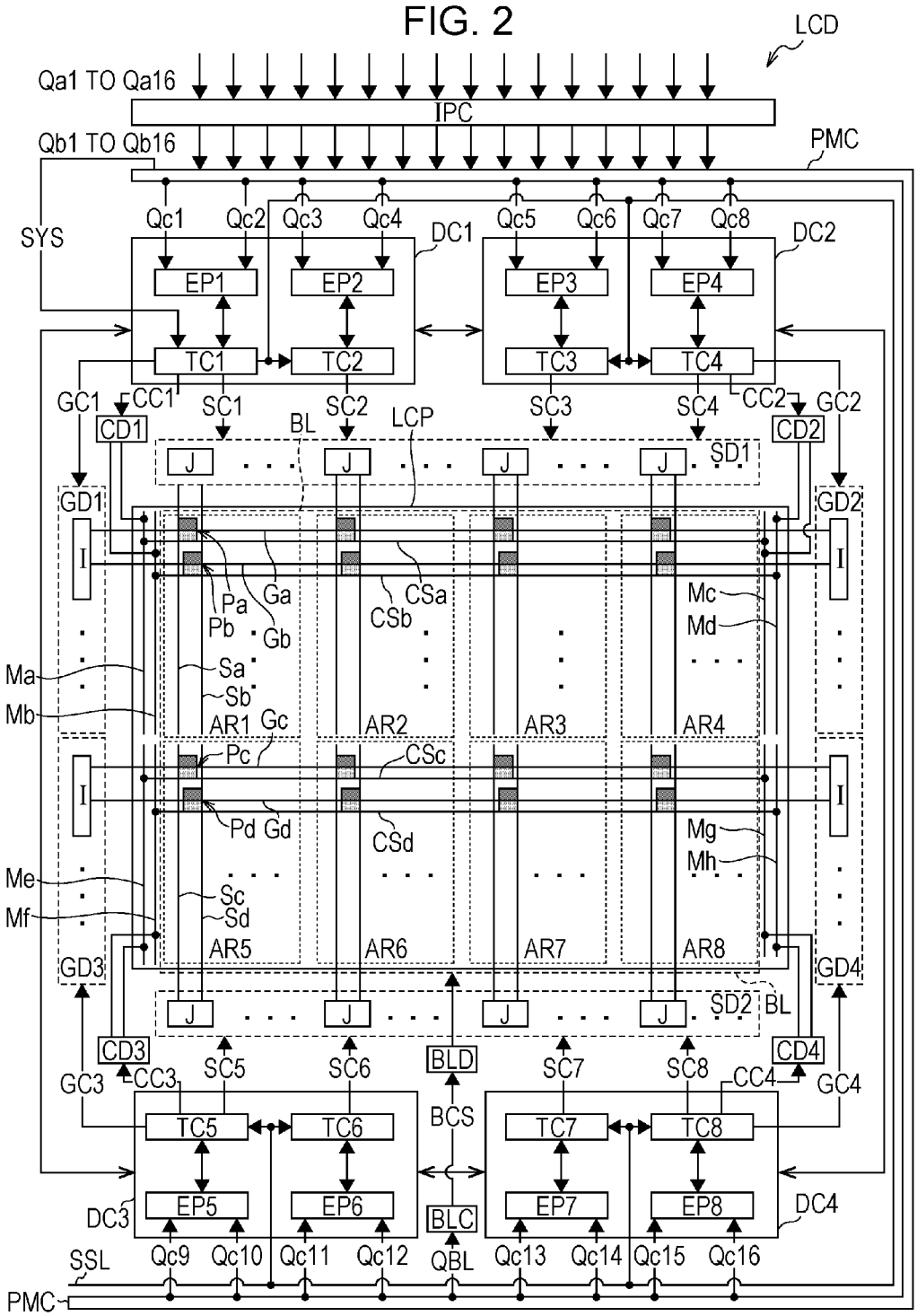
FIG. 2 is a schematic diagram illustrating a state where a plurality of display control substrates are connected to each other.

A liquid crystal display LCD according to the embodiment copes with a video standard (for example, 7680 horizontal pixels×4320 vertical pixels of super high vision) of which the number of pixels (8K4K) is 16 times the number of pixels of a full HD (1920 horizontal pixels×1080 vertical pixels). As illustrated in FIG. 2, the liquid crystal display includes the followings: an input process circuit IPC; a pixel mapping circuit PMC; four display control substrates (timing controller substrates) DC1 to DC4; a liquid crystal panel LCP; four gate drivers GD1 to GD4; two source drivers SD1 to SD2; four CS drivers CD1 to CD4; three power supply apparatuses (not illustrated) which are connected to different commercial power supplies, respectively; a power supply controller (not illustrated); a backlight BL; a backlight driver BLD; and a backlight controller BLC. Herein, four of the display control substrates (so-called timing controller substrates) DC1 to DC4 control a display of a liquid crystal panel LCP (particularly, large-sized high-definition liquid crystal panel).

A video signal input to the input process circuit IPC may be a video signal (for example, a super high vision) which has 8K4K pixels of a block scan format, or may be a video signal which has 8K4K pixels of a multi-display format. Certainly, the video signal may be a video signal which has 4K2K pixels, or may be a video signal which has 2K1K pixels (the number of pixels of the full HD).

The block scan format is a method in which a frame (entire image with 8K4K pixels) is divided into 16 sheets of images (so-called thinned images) with a rough resolution in its entirety (with the number of pixels of the full HD) to be transmitted. In this case, each of sixteen video signals Qa1 to Qa16 input to the input process circuit IPC becomes the entire image with a rough resolution (with the number of pixels of the full HD).

The multi-display format is a method in which a frame (entire image with 8K4K pixels) is divided into 16 sheets of images without the fineness of a resolution being changed and the divided 16 sheets of partial images are transmitted. In this case, each of sixteen of the video signals Qa1 to Qa16 input to the input process circuit IPC becomes a partial image with a fine resolution (with the number of pixels of the full HD).

The input process circuit IPC performs a synchronization process of video data; a γ correction process; a color temperature correction process; and a color gamut conversion process. The input process circuit outputs video signals Qb1 to Qb16 to the pixel mapping circuit PMC.

Herein, the display control substrate DC1 includes two video process circuits EP1 and EP2 and two timing controllers TC1 and TC2. The display control substrate DC2 includes two video process circuits EP3 and EP4 and two timing controllers TC3 and TC4. The display control substrate DC3 includes two video process circuits EP5 and EP6 and two timing controllers TC5 and TC6. The display control substrate DC4 includes two video process circuits EP7 and EP8 and two timing controllers TC7 and TC8.

The pixel mapping circuit PMC divides a video signal (with 2K2K pixels) which corresponds to a left half AR1 of a local area 1 (upper left area when the liquid crystal panel LCP is divided into four upper, lower, left and right areas) into two signals (video signals Qc1 and Qc2 with the number of pixels of the full HD) to output the divided signals to the video process circuit EP1 of the display control substrate DC1. The pixel mapping circuit PMC divides a video signal (with 2K2K pixels) which corresponds to a right half AR2 of the local area 1 into two signals (video signals Qc3 and Qc4 with the number of pixels of the full HD) to output the divided signals to the video process circuit EP2 of the display control substrate DC1. The pixel mapping circuit PMC divides a video signal (2K2K pixels) which corresponds to a left half AR3 of a local area 2 (upper right area when the liquid crystal panel LCP is divided into four upper, lower, left and right areas) into two signals (video signals Qc5 and Qc6 with the number of pixels of the full HD) to output the divided signals to the video process circuit EP3 of the display control substrate DC2. The pixel mapping circuit PMC divides a video signal (2K2K pixels) which corresponds to a right half AR4 of the local area 2 into two signals (video signals Qc7 and Qc8 with the number of pixels of the full HD) to output the divided signals to the video process circuit EP4 of the display control substrate DC2. The pixel mapping circuit PMC divides a video signal (2K2K pixels) which corresponds to a left half AR5 of a local area 3 (lower left area when the liquid crystal panel LCP is divided into four upper, lower, left and right areas) into two signals (video signals Qc9 and Qc10 with the number of pixels of the full HD) to output the divided signals to the video process circuit EP5 of the display control substrate DC3. The pixel mapping circuit PMC divides a video signal (2K2K pixels) which corresponds to a right half AR6 of the local area 3 into two signals (video signals Qc11 and Qc12 with the number of pixels of the full HD) to output the divided signals to the video process circuit EP6 of the display control substrate DC3. The pixel mapping circuit PMC divides a video signal (2K2K pixels) which corresponds to a left half AR7 of a local area 4 (lower right area when the liquid crystal panel LCP is divided into four upper, lower, left and right areas) into two signals (video signals Qc13 and Qc14 with the number of pixels of the full HD) to output the divided signals to the video process circuit EP7 of the display control substrate DC4. The pixel mapping circuit PMC divides a video signal (2K2K pixels) which corresponds to a right half AR8 of the local area 4 into two signals (video signals Qc15 and Qc16 with the number of pixels of the full HD) to output the divided signals to the video process circuit EP8 of the display control substrate DC4.

Furthermore, the pixel mapping circuit PMC outputs a synchronization signal SYS (vertical synchronization signal, horizontal synchronization signal, clock signal, data enable signal, polarity inversion signal, and the like) to the timing controller TC1 of the display control substrate DC1, and the timing controller TC1 transmits the received synchronization signal SYS to a substrate shared line SSL which are connected to the display control substrates DC1 to DC4.

After the timing controller TC1 receives the synchronization signal SYS from the pixel mapping circuit PMC and cooperates with the video process circuit EP1 to perform a video process of the video signals Qc1 and Qc2 such as a gradation conversion process and a frame rate conversion (FRC) process of the video signals Qc1 and Qc2, the timing controller TC1 outputs a source control signal SC1 to a source driver substrate (not illustrated) which corresponds to the AR1; a gate control signal GC1 to a gate driver substrate (not illustrated) of the gate driver GD1; and a CS control signal CC1 to the CS driver CD1.

After the timing controller TC2 receives the synchronization signal SYS transmitted from the timing controller TC1 via the substrate shared line SSL and cooperates with the video process circuit EP2 to perform the video process of the video signals Qc3 and Qc4, the timing controller TC2 outputs a source control signal SC2 to a source driver substrate (not illustrated) which corresponds to the AR2.

After the timing controller TC3 receives the synchronization signal SYS transmitted from the timing controller TC1 via the substrate shared line SSL and cooperates with the video process circuit EP3 to perform the video process of the video signals Qc5 and Qc6, the timing controller TC3 outputs a source control signal SC3 to a source driver substrate (not illustrated) which corresponds to the AR3.

After the timing controller TC4 receives the synchronization signal SYS transmitted from the timing controller TC1 via the substrate shared line SSL and cooperates with the video process circuit EP4 to perform the video process of the video signals Qc7 and Qc8, the timing controller TC4 outputs a source control signal SC4 to a source driver substrate (not illustrated) which corresponds to the AR4; a gate control signal GC2 to a gate driver substrate (not illustrated) of the gate driver GD2; and a CS control signal CC2 to the CS driver CD2.

After the timing controller TC5 receives the synchronization signal SYS transmitted from the timing controller TC1 via the substrate shared line SSL and cooperates with the video process circuit EP5 to perform the video process of the video signals Qc9 and Qc10, the timing controller TC5 outputs a source control signal SC5 to a source driver substrate (not illustrated) which corresponds to the AR5; a gate control signal GC3 to a gate driver substrate (not illustrated) of the gate driver GD3; and a CS control signal CC3 to the CS driver CD3.

After the timing controller TC6 receives the synchronization signal SYS transmitted from the timing controller TC1 via the substrate shared line SSL and cooperates with the video process circuit EP6 to perform the video process of the video signals Qc11 and Qc12, the timing controller TC6 outputs a source control signal SC6 to a source driver substrate (not illustrated) which corresponds to the AR6.

After the timing controller TC7 receives the synchronization signal SYS transmitted from the timing controller TC1 via the substrate shared line SSL and cooperates with the video process circuit EP7 to perform the video process of the video signals Qc13 and Qc14, the timing controller TC7 outputs a source control signal SC7 to a source driver substrate (not illustrated) which corresponds to the AR7.

After the timing controller TC8 receives the synchronization signal SYS transmitted from the timing controller TC1 via the substrate shared line SSL and cooperates with the video process circuit EP8 to perform the video process of the video signals Qc15 and Qc16, the timing controller TC8 outputs a source control signal SC8 to a source control substrate (not illustrated) which corresponds to the AR8; a gate control signal GC4 to a gate driver substrate (not illustrated) of the gate driver GD4; and a CS control signal CC4 to the CS driver CD4.

The source control signals SC1 to SC8 contain data signals, data enable signals (DE signals), source start pulses and source clocks, and the gate control signals GC1 to GC4 contain initial signals, gate start pulses and gate clocks.

Herein, the gradation conversion process may contain a gradation correction process dependent on a pixel position (position in a column direction) in order to cope with combinations of a high-speed display process (QS process) or panel top/bottom division driving (will be described in detail below) and 1V inversion driving (will be described in detail below) of a data signal line.

In addition, the FRC process may calculate a motion vector in each of the video process circuits by use of any one (entire image with a rough resolution and with the number of pixels of the full HD) of sixteen of the video signals Qa1 to Qa16, and the FRC process may generate a partial image (with the number of pixels of the full HD) for interpolation by use of one corresponding video signal (partial image with a fine resolution and with the number of pixels of the full HD) out of the video signals Qc1 to Qc16.

In addition, a 12-bit transmission of HDMI (high-definition multimedia interface) is used for the input of the video signals Qc1 to Qc16, thereby causing an error that DE signals (equivalent to 1920 lines) are further extended by one clock (equivalent to one line) to become equivalent to 1921 lines. Accordingly, in a case where the widths of the DE signals are monitored and the DE signals becomes equivalent to 1921 lines, an error correction process can be performed to delay startups of the DE signals by one clock. That is, data signals (for example, video signals Qc1 to Qc4) and effective signals (DEs) which indicate effective periods of the data signals are input to the display control substrate DC1 via an input interface (for example, HDMI), and the display control substrate DC1 has a detection unit that detects at least one of content of the data signals and active periods of the effective signals obtained based on the effective signals; and a correction unit that corrects phase shifts of the effective signals based on detection results of the detection unit. In this way, malfunction (particularly, malfunction which is likely to occur when the HDMI is used) of the data signals caused by the phase shifts of the effective signals can be resolved.

The display control substrates DC1 to DC4 exchange or share various types of signals between the substrates to synchronize operations thereof with each other. Specifically, the display control substrate DC1 which is a master transmits a RDY (readiness) signal to the display control substrate DC2 which is a slave; as soon as the display control substrate DC2 which receives the RDY signal is in readiness, the display control substrate DC2 transmits the RDY signal to the display control substrate DC3 which is a slave; as soon as the display control substrate DC3 which receives the RDY signal is in readiness, the display control substrate DC3 transmits the RDY signal to the display control substrate DC4 which is a slave; and as soon as the display control substrate DC4 which receives the RDY signal is in readiness, the display control substrate DC4 transmits the RDY signal back to the display control substrate DC1. When the RDY signal is transmitted back to the display control substrate DC1, the display control substrate DC1 transmits an operation start (SRST) signal to the display control substrates DC2 to DC4 all at once via the substrate shared line SSL. After the operation start (SRST) signal is transmitted, the timing controller TC1 of the display control substrate DC1 transmits the synchronization signal SYS, which is received from the pixel mapping circuit PMC, to the timing controllers TC2 to TC8 all at once via the substrate shared line SSL. Description will be made more in detail as follows.

Figure 1:
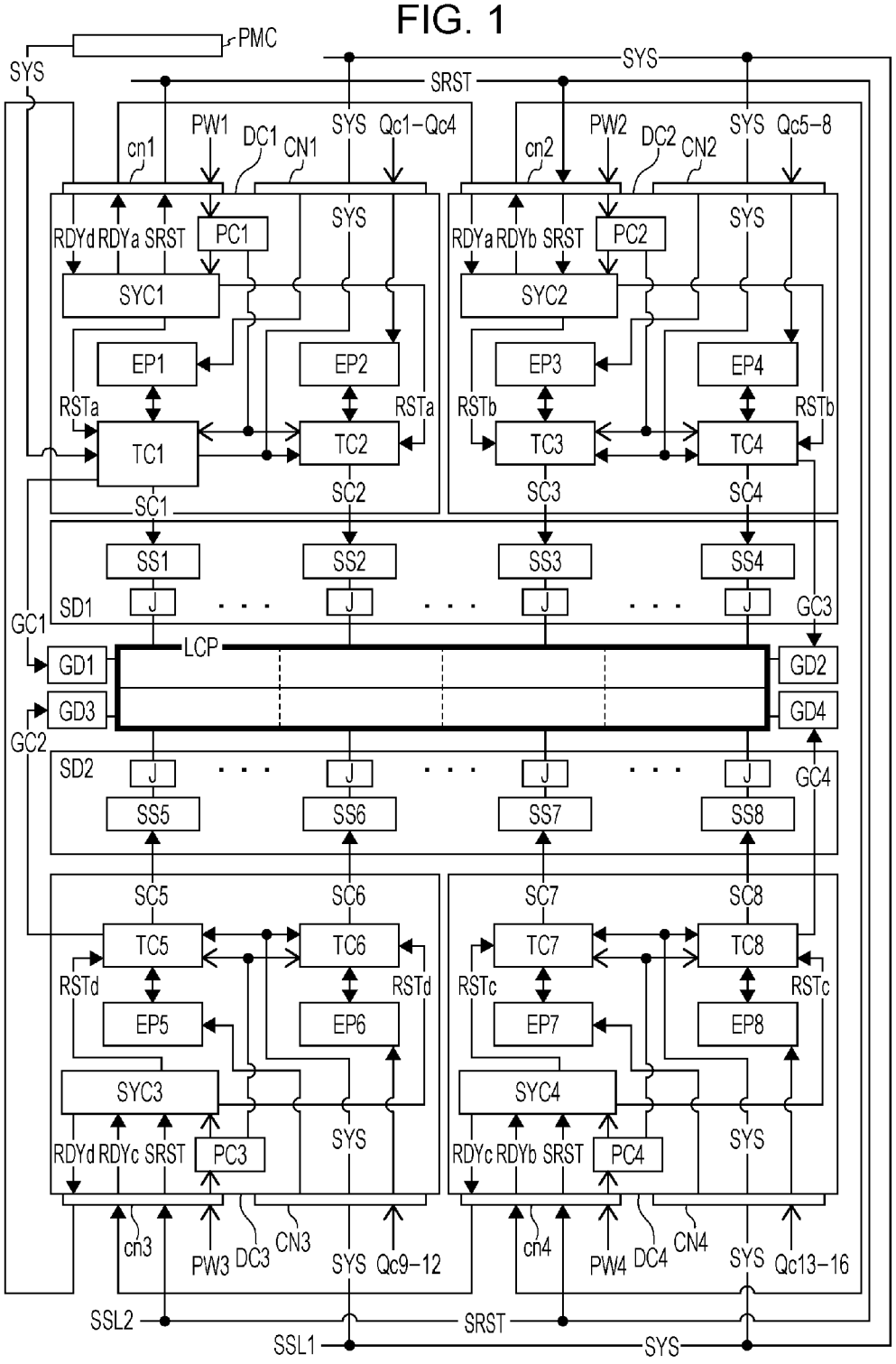
FIG. 1 is a schematic diagram illustrating a configuration of a liquid crystal display according to EXAMPLE 1.

As illustrated in FIG. 1, the display control substrate DC1 includes a local power supply circuit PC1; a video connector CN1 to which the video signals Qc1 to Qc4 are input; a synchronization connector cn1; a synchronization circuit SYC1; the timing controller TC1 and TC2; and the video process circuits EP1 and EP2. The local power supply circuit PC1 is connected to the synchronization circuit SYC1; the timing controllers TC1 and TC2; and the video process circuits EP1 and EP2 (not illustrated). The synchronization circuit SYC1 is connected to the synchronization connector cn1 and the timing controllers TC1 and TC2. The timing controller TC1 is connected to the video process circuit EP1 and the timing controller TC2, and the timing controller TC2 is connected to the video process circuit EP2 and the timing controller TC1.

In addition, the display control substrate DC2 includes a local power supply circuit PC2; a video connector CN2 to which the video signals Qc5 to Qc8 are input; a synchronization connector cn2; a synchronization circuit SYC2; the timing controller TC3 and TC4; and the video process circuits EP3 and EP4. The local power supply circuit PC2 is connected to the synchronization circuit SYC2; the timing controllers TC3 and TC4; and the video process circuits EP3 and EP4 (not illustrated). The synchronization circuit SYC2 is connected to the synchronization connector cn2 and the timing controllers TC3 and TC4. The timing controller TC3 is connected to the video process circuit EP3 and the timing controller TC4, and the timing controller TC4 is connected to the video process circuit EP4 and the timing controller TC3.

In addition, the display control substrate DC3 includes a local power supply circuit PC3; a video connector CN3 to which the video signals Qc9 to Qc12 are input; a synchronization connector cn3; a synchronization circuit SYC3; the timing controllers TC5 and TC6; and the video process circuits EP5 and EP6. The local power supply circuit PC3 is connected to the synchronization circuit SYC3; the timing controllers TC5 and TC6; and the video process circuits EP5 and EP6 (not illustrated). The synchronization circuit SYC3 is connected to the synchronization connector cn3 and the timing controllers TC5 and TC6. The timing controller TC5 is connected to the video process circuit EP5 and the timing controller TC6, and the timing controller TC6 is connected to the video process circuit EP6 and the timing controller TC5.

In addition, the display control substrate DC4 includes a local power supply circuit PC4; a video connector CN4 to which the video signals Qc13 to Qc16 are input; a synchronization connector cn4; a synchronization circuit SYC4; the timing controller TC7 and TC8; and the video process circuits EP7 and EP8. The local power supply circuit PC4 is connected to the synchronization circuit SYC4; the timing controllers TC7 and TC8; and the video process circuits EP7 and EP8 (not illustrated). The synchronization circuit SYC4 is connected to the synchronization connector cn4 and the timing controllers TC7 and TC8. The timing controller TC7 is connected to the video process circuit EP7 and the timing controller TC8, and the timing controller TC8 is connected to the video process circuit EP8 and the timing controller TC7.

The display control substrate DC1 is operated as a master, and the display control substrates DC2 to DC4 are operated as a slave.

Each of the video connectors CN1 to CN4 is connected to a synchronization-purpose shared line SSL1, and the synchronization connectors cn1 to cn4 are connected to a reset-purpose shared line SSL2.

When a power supply voltage signal from the local power supply circuit PC1 is equal to or larger than a threshold level, the synchronization circuit SYC1 sets a preparation signal RDYa to be active (readiness signal) and transmits the active preparation signal RDYa to the synchronization circuit SYC2 via the synchronization connectors cn1 and cn2. When the preparation signal RDYa from the synchronization circuit SYC1 is active and a power supply voltage signal from the local power supply circuit PC2 is equal to or larger than a threshold level, the synchronization circuit SYC2 sets a preparation signal RDYb to be active (readiness signal) and transmits the active preparation signal RDYb to the synchronization circuit SYC4 via the synchronization connectors cn2 and cn4. When the preparation signal RDYb from the synchronization circuit SYC2 is active and a power supply voltage signal from the local power supply circuit PC4 is equal to or larger than a threshold level, the synchronization circuit SYC4 sets a preparation signal RDYc to be active (readiness signal) and transmits the active preparation signal RDYc to the synchronization circuit SYC3 via the synchronization connectors cn4 and cn3. When the preparation signal RDYc from the synchronization circuit SYC4 is active and a power supply voltage signal from the local power supply circuit PC3 is equal to or larger than a threshold level, the synchronization circuit SYC3 sets a preparation signal RDYd to be active (readiness signal) and transmits the active preparation signal RDYd to the synchronization circuit SYC1 via the synchronization connectors cn3 and cn1.

When the preparation signal RDYd from the synchronization circuit SYC3 becomes active, the synchronization circuit SYC1 sets a reset signal SRST to be inactive (reset release signal) and transmits the inactive reset signal SRST to the reset-purpose shared line SSL2 via the synchronization connector cn1 and to the timing controller TC2. The reset release signal is transmitted to the synchronization circuits SYC2 to SYC4 all at once via the reset-purpose shared line SSL2 and the synchronization connectors cn2 to cn4.

The synchronization circuit SYC2 which receives the reset release signal sets a reset release signal RSTb to the timing controllers TC3 and TC4 to be active, and thus, preparations of operations of the timing controllers TC3 and TC4 are completed. In addition, the synchronization circuit SYC4 which receives the reset release signal sets a reset release signal RSTc to the timing controllers TC7 and TC8 to be active, and thus, preparations of operations of the timing controllers TC7 and TC8 are completed. In addition, the synchronization circuit SYC3 which receives the reset release signal sets a reset release signal RSTd to the timing controllers TC5 and TC6 to be active, and thus, preparations of operations of the timing controllers TC5 and TC6 are completed.

The synchronization signal SYS (vertical synchronization signal, horizontal synchronization signal, clock signal, data enable signal, polarity inversion signal, and the like) which is input to the timing controller TC1 is transmitted to the timing controllers TC2 to TC8 from the timing controller TC1 via the video connector CN1, the synchronization-purpose shared line SSL1 and then the video connectors CN2 to CN4. Accordingly, a synchronization operation of the timing controllers TC1 to TC8 is started.

Figure 3:
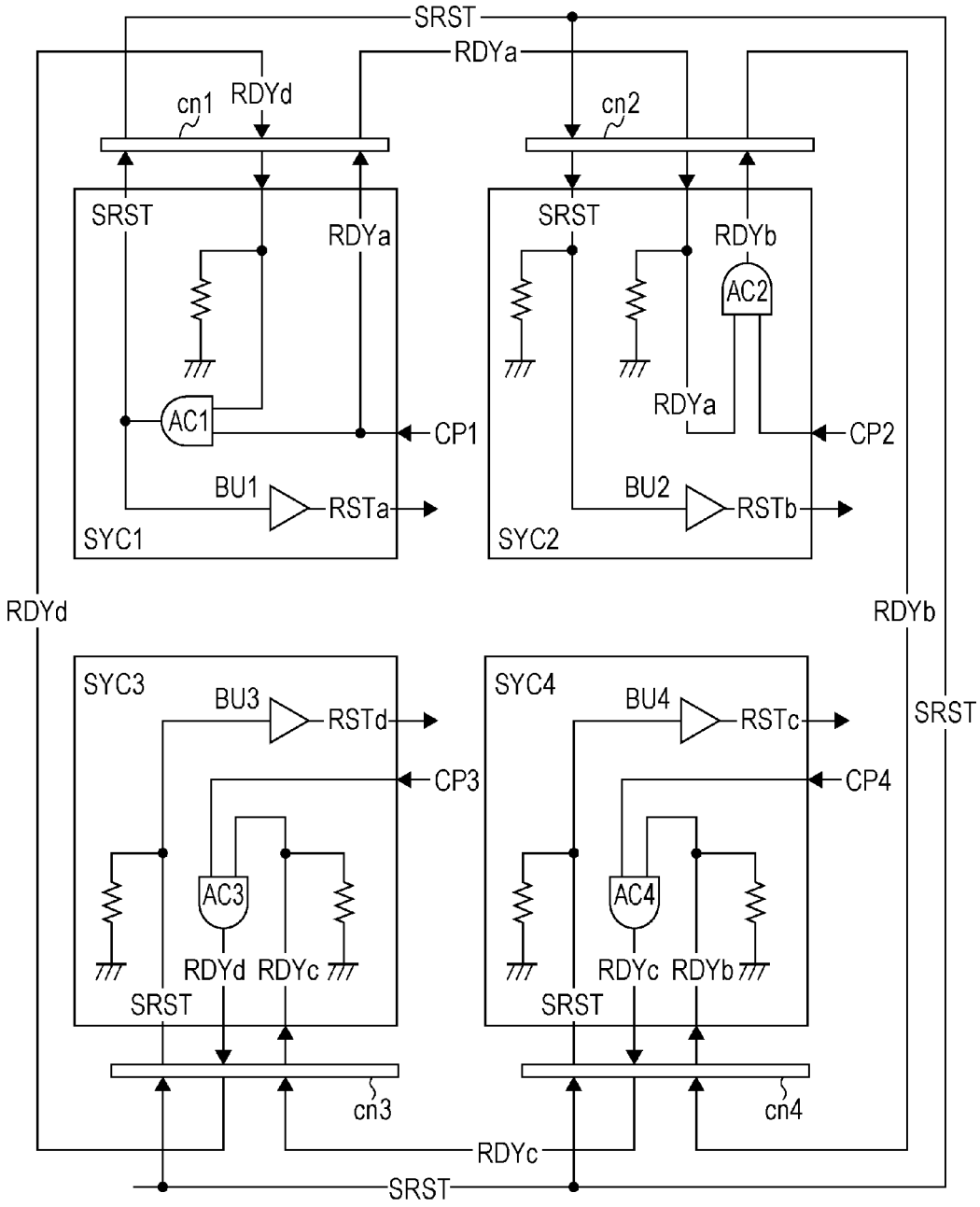
FIG. 3 is a circuit diagram illustrating a configuration example of a portion of FIG. 2.
Figure 4:
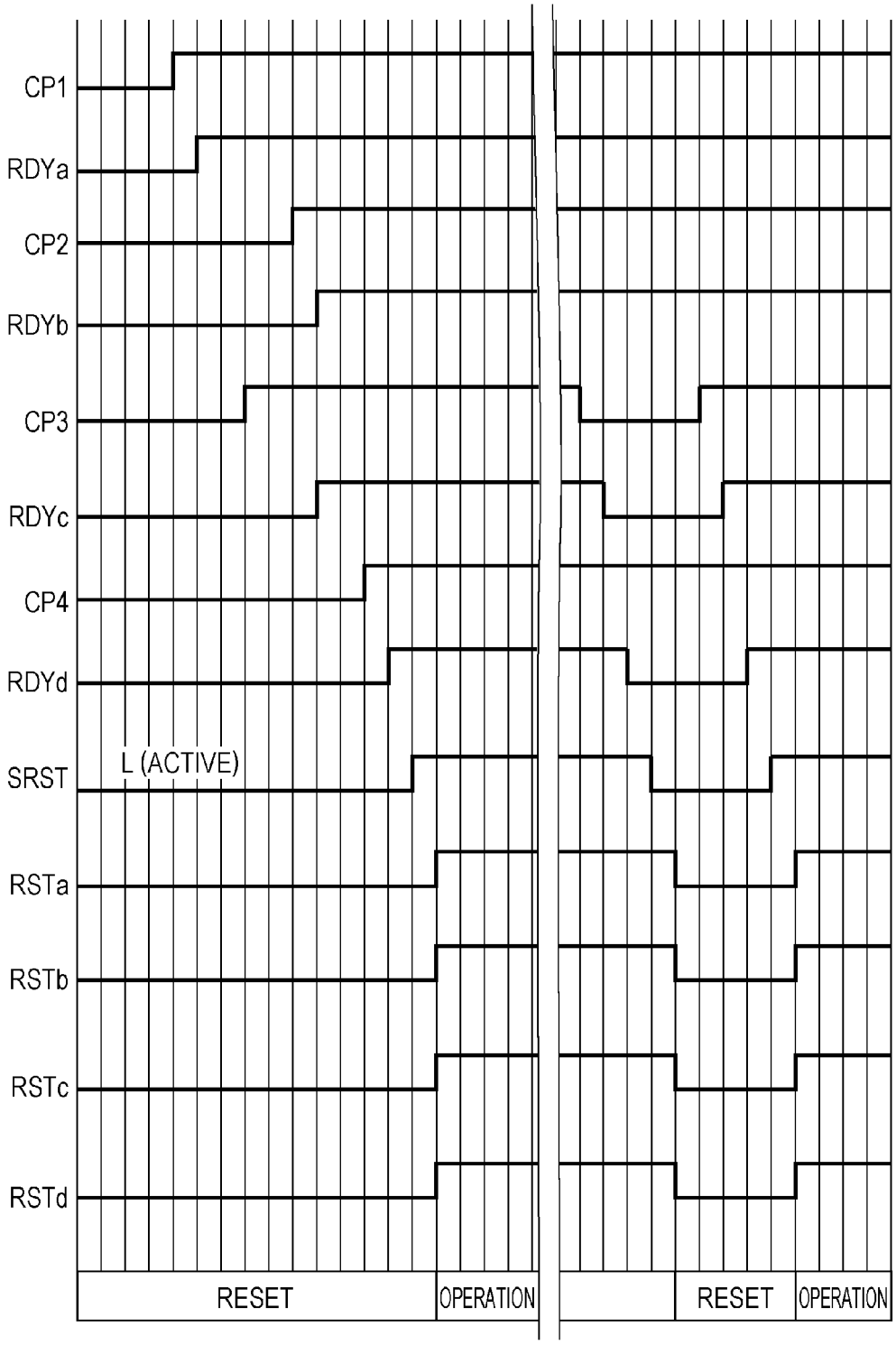
FIG. 4 is a timing chart illustrating an operation of each of the display control substrates in EXAMPLE 1.

FIG. 3 is a circuit diagram illustrating a specific example of FIG. 1, and FIG. 4 is a timing chart illustrating an operation of a configuration of FIG. 3. As illustrated in FIGS. 3 and 4, the synchronization circuit SYC1 includes an AND circuit AC1 and a backup circuit BU1; the synchronization circuit SYC2 includes an AND circuit AC2 and a backup circuit BU2; the synchronization circuit SYC3 includes an AND circuit AC3 and a backup circuit BU3; and the synchronization circuit SYC4 includes an AND circuit AC4 and a backup circuit BU4.

First, when a power supply voltage signal CP1 from the local power supply circuit PC1 becomes "H" which is equal to or larger than a threshold level, the preparation signal RDYa becomes active "H" (readiness signal) and is transmitted to the AND circuit AC2 of the synchronization circuit SYC2 via the synchronization connectors cn1 and cn2. The preparation signal RDYa and a power supply voltage signal CP2 from the local power supply circuit PC2 are input to the AND circuit AC2. When both of the preparation signal RDYa and the power supply voltage signal CP2 become active "H", the preparation signal RDYb becomes active "H" (readiness signal) and is transmitted to the AND circuit AC4 of the synchronization circuit SYC4 via the synchronization connectors cn2 and cn4. The preparation signal RDYb and a power supply voltage signal CP4 from the local power supply circuit PC4 are input to the AND circuit AC4. When both of the preparation signal RDYb and the power supply voltage signal CP4 become active "H", the preparation signal RDYc becomes active "H" (readiness signal) and is transmitted to the AND circuit AC3 of the synchronization circuit SYC3 via the synchronization connectors cn4 and cn3. The preparation signal RDYc and a power supply voltage signal CP3 from the local power supply circuit PC3 are input to the AND circuit AC3. When both of the preparation signal RDYc and the power supply voltage signal CP3 become active "H", the preparation signal RDYd becomes active "H" (readiness signal) and is transmitted to the AND circuit AC1 of the synchronization circuit SYC1 via the synchronization connectors cn3 and cn1. The preparation signal RDYd and the power supply voltage signal CP1 from the local power supply circuit PC1 are input to the AND circuit AC1. When the preparation signal RDYd becomes active "H", the reset signal SRST becomes inactive "H" (reset release signal). The reset release signal is transmitted to the backup circuit BU1 and is transmitted to the backup circuits BU2 to BU4 all at once via the connector cn1, the reset-purpose shared line SSL2 and the connectors cn2 to cn4, and the reset release signals RSTa to RSTd become active "H". The backup circuits BU1 to BU4 perform an impedance conversion.

According to the configuration, after preparations of operations of all the display control substrates DC1 to DC4 are completed, the display control substrates DC1 to DC4 can start a synchronization operation thereof and a video failure, when a power supply is turned on or the apparatus is recovered from a fail-safe, can be avoided.

In FIG. 1, 8 sheets of the timing controllers are used, but 4 sheets or 2 sheets of the timing controllers may be configured based on a pattern of a display unit being divided. In addition, various types of signals contained in the synchronization signal SYS are also preferably determined as necessary. The local power supply circuits PC1 to PC4 may be simultaneously started up (power supply may be turned on) or may be sequentially started up.

Since the preparation signals RDYa to RDYd and the reset signal SRST undergo a pull-down process by resistances in FIG. 3, an input status is unlikely to be unstable even in a case where a power supply to a display control substrate at the previous stage is not turned on or even in a case where a connection line is disconnected. Since the preparation signals RDYa to RDYd are set to be a positive logic and the reset signal SRST is set to be a negative logic in FIG. 4, the preparation signals RDYa to RDYd and the reset signal SRST undergo a pull-down process in FIG. 3. However, when the preparation signals are set to be a negative logic and the reset signal is set to be a positive logic, the preparation signals RDYa to RDYd and the reset signal SRST preferably undergo a pull-up process.

In addition, in a case where an abnormality in display control of any display control substrate occurs while the display control substrates DC1 to DC4 are in operation, a fail-safe signal transmitted from the display control substrate in an abnormal condition is transmitted to (via transmission or simultaneous transmission via a shared line) all of other display control substrates and all the display control substrates instantaneously enter a self-running (black display) mode. Accordingly, a video failure is avoided.

In addition, various types of drive power supplies are independently generated in each of the display control substrates DC1 to DC4, and a line, through which the same type (the same electrical potential and the same phase) of a drive power supply is supplied, is connected between the display control substrates via a current limit circuit. In this way, the same type of the drive power supply can be adjusted, and an over current caused by deviations in start-ups of the substrates can be prevented from flowing through various types of the drivers or the display control substrates.

The liquid crystal panel LCP includes an active matrix substrate, a liquid crystal layer (not illustrated) and an opposite substrate (not illustrated). The following are provided in the active matrix substrate: a plurality of pixel electrodes (not illustrated); a plurality of thin film transistors (TFTs and not illustrated); scanning signal lines Ga to Gd which are stretched in a row direction (direction along a long side of the panel); a plurality of data signal lines Sa to Sd which are stretched in a column direction; holding-up capacitance wirings (CS wirings) CSa to CSd which are stretched in the row direction; and CS stem wirings Ma to Mh which are stretched in the column direction. A common electrode (not illustrated), a color filter and a black matrix (not illustrated) are provided in the opposite substrate.

In addition, the gate driver GD1 is provided along one side of two short sides on an upper half portion of the liquid crystal panel LCP, and the gate driver GD1 contains a plurality of gate driver chips I which are lined up in the column direction. The vertical driver GD2 is provided along the other side of two of the short sides on the upper half portion of the liquid crystal panel LCP, and the vertical driver GD2 contains a plurality of gate driver chips I which are lined up in the column direction. In addition, the gate driver GD3 is provided along one side of two short sides on a lower half portion of the liquid crystal panel LCP, and the gate driver GD3 contains a plurality of gate driver chips I which are lined up in the column direction. The vertical driver GD4 is provided along the other side of two of the short sides on the lower half portion of the liquid crystal panel LCP, and the vertical driver GD4 contains a plurality of gate driver chips I which are lined up in the column direction. The gate drivers GD1 and GD2 drive each scanning signal line provided on the upper half portion of the panel, and the gate drivers GD3 and GD4 drive each scanning signal line provided on the lower half portion of the panel. That is, a scanning signal line is connected to two gate drivers which are arranged on both sides of the signal line, and scanning (pulse) signals with the same phase are supplied to one scanning signal line from two of the gate drivers. In this way, a variation (which indicates that a degree of the signal unsharpness changes based on a position of the scanning signal line in the row direction) in signal unsharpness caused by a time constant (CR) of the scanning signal line can be suppressed.

The source driver SD1 is provided along a long side on the upper half portion of the liquid crystal panel LCP, and the source driver SD1 contains 48 pieces of source driver chips J (a source driver chip has 960 pieces of output terminals) which are lined up in the row direction; and four source driver substrates (12 pieces of the source driver chips J are mounted on a source driver substrate) which are not illustrated. On the other hand, the source driver SD2 is provided along a long side on the lower half portion of the liquid crystal panel LCP, and the source driver SD2 contains 48 pieces of source driver chips J (a source driver chip has 960 pieces of output terminals) which are lined up in the row direction; and four source driver substrates (12 pieces of the source driver chips J are mounted on a source driver substrate) which are not illustrated. The source driver SD1 drives each data signal line provided on the upper half portion of the panel, and the source driver SD2 drives each data signal line provided on the lower half portion of the panel. For example, the data signal line Sa is driven by the source driver SD1, and the data signal line Sc is driven by the source driver SD2. When the source driver chips J cannot be lined up along the long side of the panel due to lack of space, the source driver chips J can be lined up on the short side of the panel on which a space is available (source driver chips J and gate driver chips I are lined up in the column direction). In this case, a relay line connect a data signal line to a source terminal on the short side of the panel, and the relay line can be provided either on the opposite substrate side or on a layer between a lower layer (gate layer) or a source layer of a gate insulator and an ITO layer (pixel electrode formation layer) in addition to a source layer of the active matrix substrate (source and drain electrodes formation layer of the TFT).

The liquid crystal panel LCP has a so-called top/bottom-division double source structure (structure in which four data signals are provided per pixel column so that four scanning signal lines can be simultaneously selected) in which two data signals are provided to correspond to an upper half portion (first area and upstream side of the panel) of a pixel column and two data signal lines are provided to correspond to a lower half portion (second area and downstream side of the panel) of the pixel column. The liquid crystal panel LCP can be driven at four times a speed.

Furthermore, the liquid crystal panel LCP adopts a so-called multi-pixel method to include at least two pixel electrodes per pixel, and viewing angle characteristics can be improved by a bright area and a dark area formed in a pixel.

Figure 8:
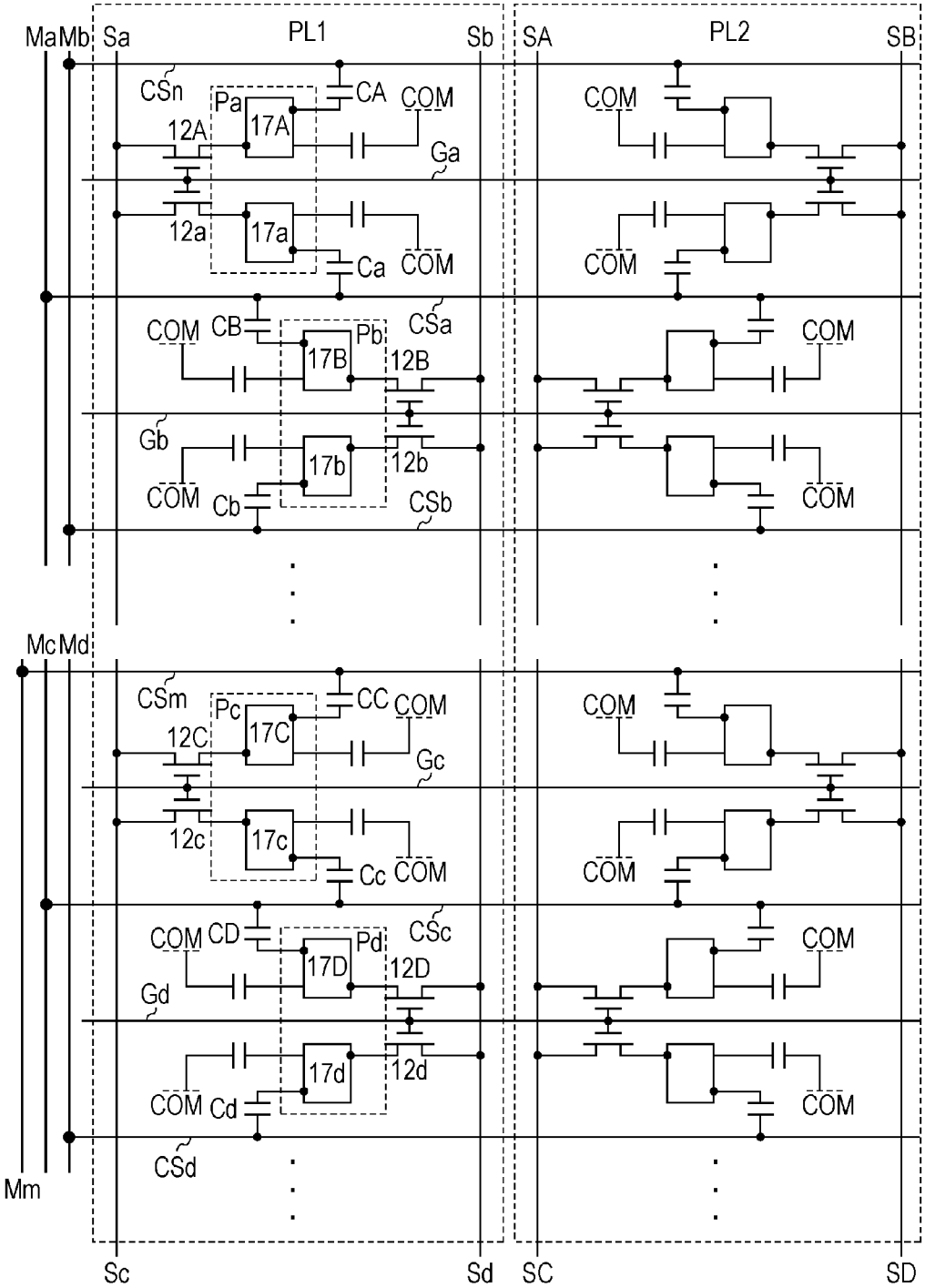
FIG. 8 is a circuit diagram illustrating a portion of a liquid crystal panel in FIG. 1.
Figure 9:
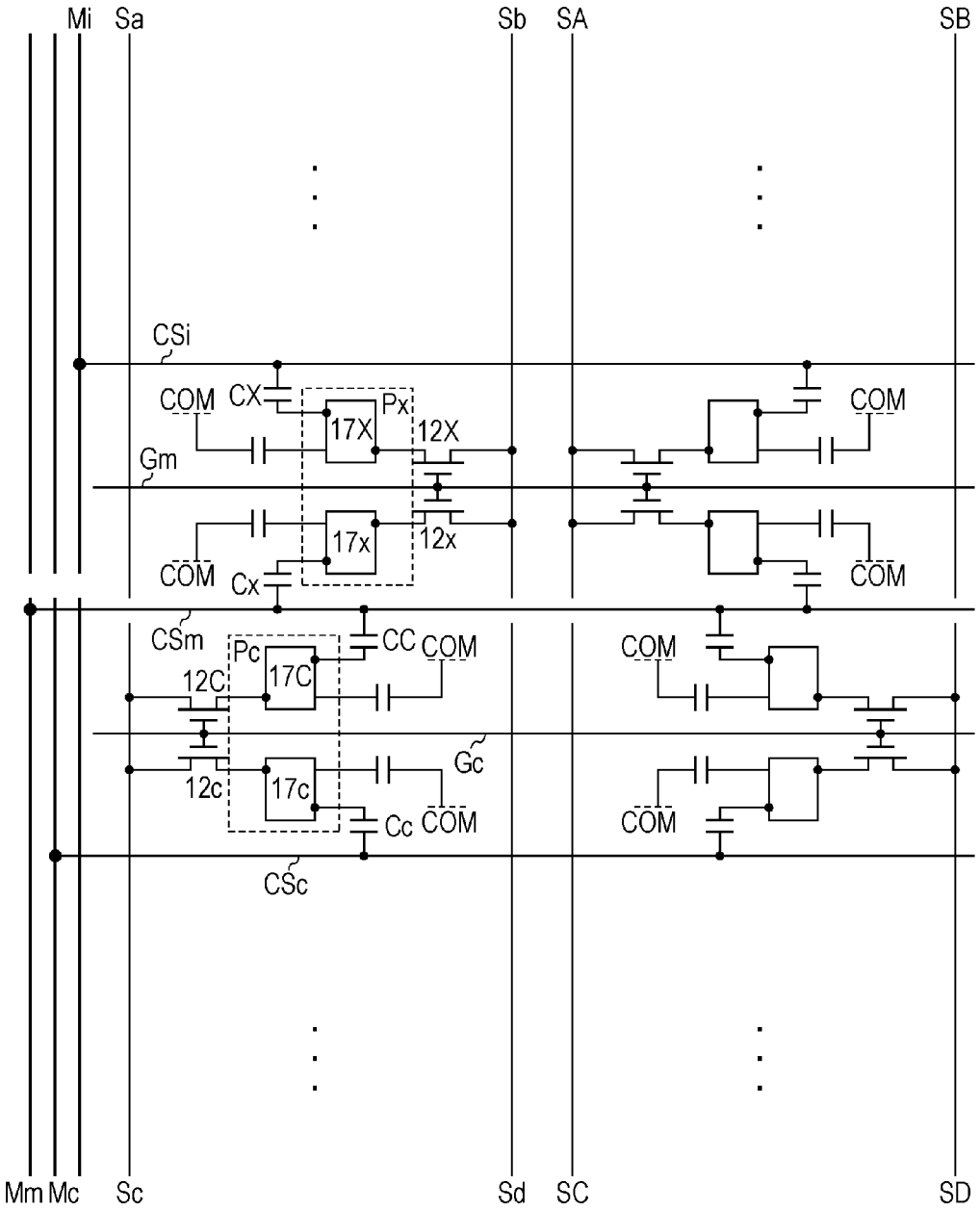
FIG. 9 is a circuit diagram illustrating a central portion of the liquid crystal panel in FIG. 1.

For example, as illustrated in FIG. 2 and FIGS. 8 to 9, the scanning signal lines Ga and Gb and the holding-up capacitance wirings CSa and CSb are provided in the upper half portion (upstream side) of the panel, and the scanning signal lines Gc and Gd and the holding-up capacitance wirings CSc and CSd are provided in the lower half portion (downstream side) of the panel. An upper half portion (upstream side) of a pixel column PL1 contains two pixels Pa and Pb which are adjacent to each other in the column direction, and a lower half portion (downstream) of the pixel column PL1 contains two pixels Pc and Pd which are adjacent to each other in the column direction. The data signal lines Sa and Sb are provided to correspond to the upper half portion (upstream) of the pixel column PL1, and the data signal lines Sc and Sd are provided to correspond to the lower half portion (downstream side) of the pixel column PL1.

A TFT 12A is connected to a pixel electrode 17A out of two pixel electrodes 17A and 17*a* which the pixel Pa contains, and a TFT 12*a* is connected to the pixel electrode 17*a*. The TFT 12A and the TFT 12*a* are connected to the data signal line Sa and the scanning signal line Ga, respectively. The pixel electrode 17A forms a holding-up capacitance wiring CSn and a holding-up capacitance CA, and the pixel electrode 17*a* forms a holding-up capacitance wiring CSa and a holding-up capacitance Ca. Furthermore, a TFT 12B is connected to a pixel electrode 17B out of two pixel electrodes 17B and 17*b* which the pixel Pb contains, and a TFT 12*b* is connected to the pixel electrode 17*b*. The TFT 12B and the TFT 12*b* are connected to the data signal line Sb and the scanning signal line Gb, respectively. The pixel electrode 17B forms a holding-up capacitance wiring CSa and a holding-up capacitance CB, and the pixel electrode 17*b* forms a holding-up capacitance wiring CSb and a holding-up capacitance Cb. Furthermore, a TFT 12C is connected to a pixel electrode 17C out of two pixel electrodes 17C and 17*c* which the pixel Pc contains, and a TFT 12*c* is connected to the pixel electrode 17*c*. The TFT 12C and the TFT 12*c* are connected to the data signal line Sc and the scanning signal line Gc, respectively. The pixel electrode 17C forms a holding-up capacitance wiring CSm and a holding-up capacitance CC, and the pixel electrode 17*c* forms a holding-up capacitance wiring CSc and a holding-up capacitance Cc. Furthermore, a TFT 12D is connected to a pixel electrode 17D out of two pixel electrodes 17D and 17*d* which the pixel Pd contains, and a TFT 12*d* is connected to the pixel electrode 17*d*. The TFT 12D and the TFT 12*d* are connected to the data signal line Sd and the scanning signal line Gd, respectively. The pixel electrode 17D forms a holding-up capacitance wiring CSc and a holding-up capacitance CD, and the pixel electrode 17*d* forms a holding-up capacitance wiring CSd and a holding-up capacitance CD. Four of the scanning signal lines Ga to Gd are simultaneously selected.

The pixel column PL1 has the data signal lines Sa and Sc arranged side by side in a left end thereof in the column direction; and the data signal lines Sb and Sd arranged side by side in a right end thereof in the column direction. A pixel column PL2 which is adjacent to the pixel column PL1 has data signal lines SA and SC arranged side by side in a left end thereof in the column direction; and data signal lines SB and SD arranged side by side in a right end thereof in the column direction.

In the pixel column PL2, two pixel electrodes, which are contained in a pixel adjacent to the pixel electrode Pa, are connected to the data signal line SB via separate TFTs; two pixel electrodes, which are contained in a pixel adjacent to the pixel electrode Pb, are connected to the data signal line SA via separate TFTs; two pixel electrodes, which are contained in a pixel adjacent to the pixel electrode Pc, are connected to the data signal line SD via separate TFTs; and two pixel electrodes, which are contained in a pixel adjacent to the pixel electrode Pd, are connected to the data signal line SC via separate TFTs.

The vicinity of a boundary between the upper half portion (first area) and the lower half portion (second area) is configured as illustrated in FIG. 9. That is, a TFT 12X is connected to a pixel electrode 17X out of two pixel electrodes 17X and 17*x* which are contained in a pixel Px that is positioned at a bottom of the first area, and a TFT 12*x* is connected to the pixel electrode 17*x*. The TFT 12X and the TFT 12*x* are connected to the data signal line Sb and a scanning signal line Gm, respectively. The pixel electrode 17X forms a holding-up capacitance wiring CSi and a holding-up capacitance, and the pixel electrode 17*x* forms a holding-up capacitance wiring CSm and a holding-up capacitance. The pixel Pc is positioned at a top of the second area.

The number of the data signal lines provided in the upper half portion of the panel is at least 7680 (pixel)×3 (primary color)×2 (double source)=46080; the number of the scanning signal lines provided in the upper half portion of the panel is at least 2160; and the number of the holding-up capacitance wirings provided in the upper half portion of the panel is at least 2160. The number of the data signal lines provided in the lower half portion of the panel is at least 46080; the number of the scanning signal lines provided in the lower half portion of the panel is at least 2160; and the number of the holding-up capacitance wirings provided in the lower half portion of the panel is at least 2160.

The CS stem wiring Ma (first stem wiring) and the CS stem wiring Mb are provided closely to one side of two short sides on an upper half portion of the active matrix substrate, and the CS stem wirings Ma and Mb are driven by the CS driver CD1 in such a manner that the CS stem wirings Ma and Mb have separate phases from each other. The CS stem wiring Mc (third stem wiring) and the CS stem wiring Md are provided closely to the other side of two of the short sides on the upper half portion of the active matrix substrate, and the CS stem wirings Mc and Md are driven by the CS driver CD2 in such a manner that the CS stem wirings Mc and Md have separate phases from each other. The CS stem wiring Me and the CS stem wiring Mf (second stem wiring) are provided closely to one side of two short sides on a lower half portion of the active matrix substrate, and the CS stem wirings Me and Mf are driven by the CS driver CD3 in such a manner that the CS stem wirings Me and Mf have separate phases from each other. The CS stem wiring Mg and the CS stem wiring Mh (fourth stem wiring) are provided closely to the other side of two of the short sides on the lower half portion of the active matrix substrate, and the CS stem wirings Mg and Mh are driven by the CS driver CD4 in such a manner that the CS stem wirings Mg and Mh have separate phases from each other. A holding-up capacitance wiring is connected to two CS stem wirings which are arranged on both sides of the holding-up capacitance wiring, and modulation (pulse) signals with the same phase are supplied to one holding-up capacitance wiring from two of the CS stem wirings. In this way, a variation (which indicates that a degree of the signal unsharpness changes based on a position of the holding-up capacitance wiring in the row direction) in signal unsharpness caused by a time constant (CR) of the holding-up capacitance wiring can be suppressed.

For example, the holding-up capacitance wiring CSa is connected to the CS stem wirings Ma and Mc; the holding-up capacitance wiring CSb is connected to the CS stem wirings Mb and Md; the holding-up capacitance wiring CSc is connected to the CS stem wirings Me and Mg; and the holding-up capacitance wiring CSd is connected to the CS stem wiring Mf and Mh. For example, when electrical potentials of the CS stem wirings Ma and Mb are controlled to have reverse phases, electrical potentials of the holding-up capacitance wirings CSa and CSb also have reverse phases. In the pixel Pb, the pixel electrode 17B out of two of the pixel electrodes 17B and 17*b* forms the holding-up capacitance wiring CSa and the capacitance and the pixel electrode 17*b* forms the holding-up capacitance wiring CSb and the capacitance. Therefore, for example, after the same signal potential is applied to the pixel electrodes 17B and 17*b*, an effective electrical potential of the pixel electrode 17*b* can be shifted toward a direction in which the effective electrical potential falls apart from a center electrical potential whereas an effective electrical potential of the pixel electrode 17B can be shifted toward a direction in which the effective electrical potential approaches the center electrical potential (thereby forming a dark area which corresponds to the pixel electrode 17B and a bright area which corresponds to the pixel electrode 17*b* in a pixel).

A polarity of a data signal supplied in a data signal line is inversed in every vertical scanning period (1V), and polarities of data signals supplied to both of two data signal lines are opposite to each other in the same vertical scanning period even though two of the signal lines are provided to correspond to a pixel column. In this way, as each data signal line undergoes a 1V inversion (that is, as a polarity inversion period is set to be long and electrical power consumption is reduced), a polar distribution of pixels in a screen can undergo a dot inversion (thereby suppressing a flicker caused by a pull-in voltage which is generated when the TFT is set to be OFF).

Figure 10:
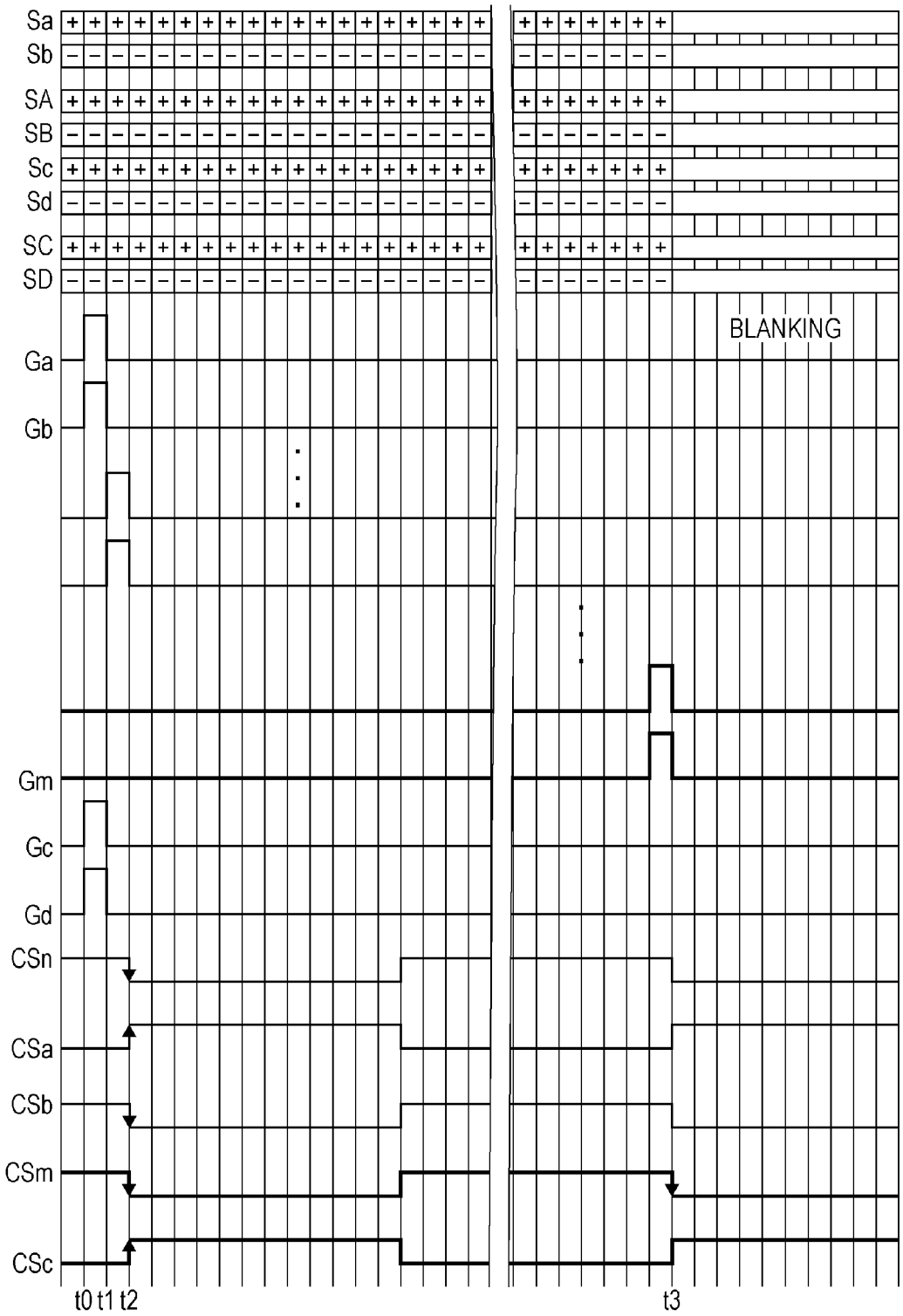
FIG. 10 is a timing chart representing a method of driving the liquid crystal panel in FIGS. 8 and 9.
Figure 11:
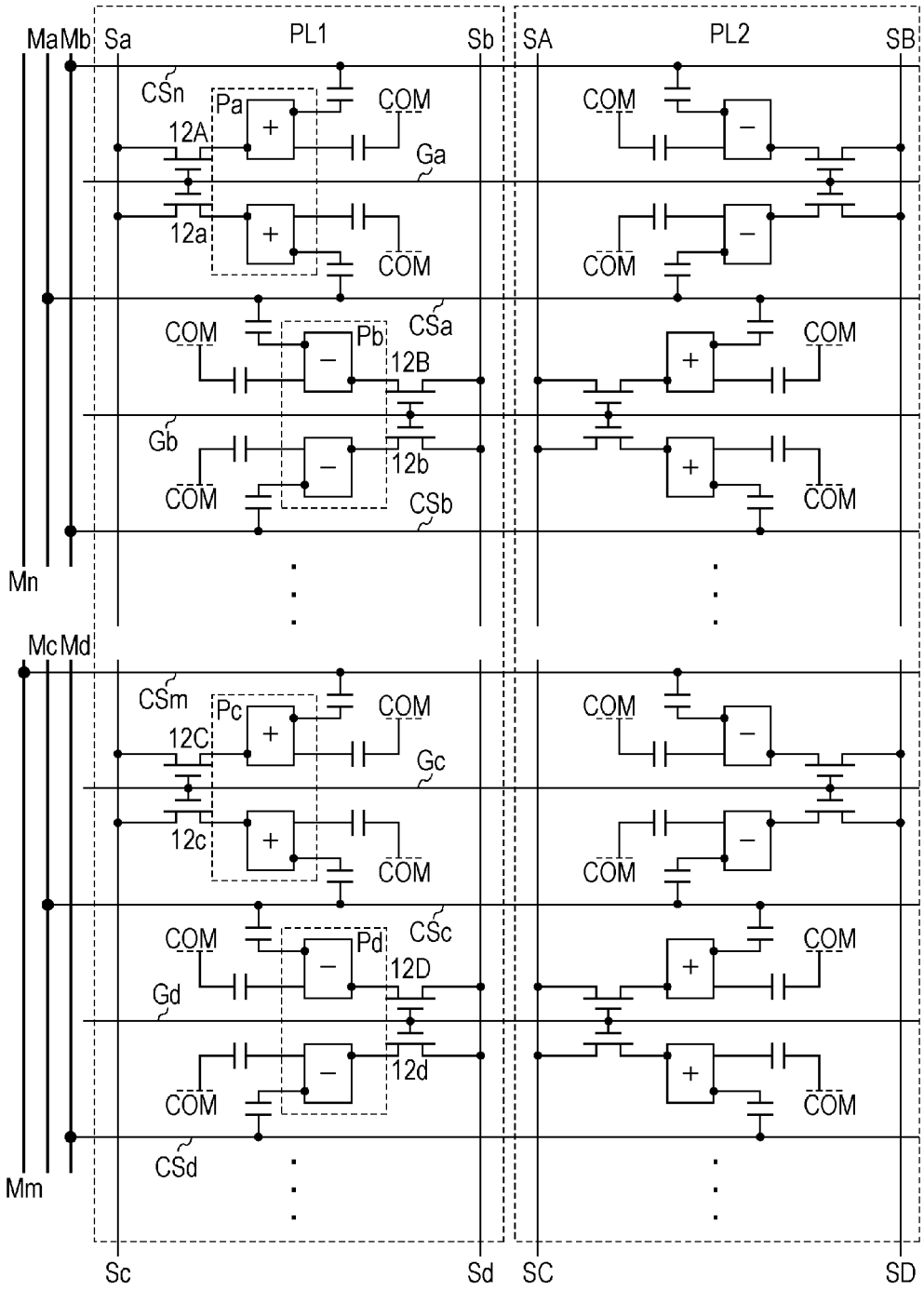
FIG. 11 is a circuit diagram illustrating a distribution of polarities of pixels (portion of FIG. 8) according to the driving method in FIG. 10.
Figure 12:
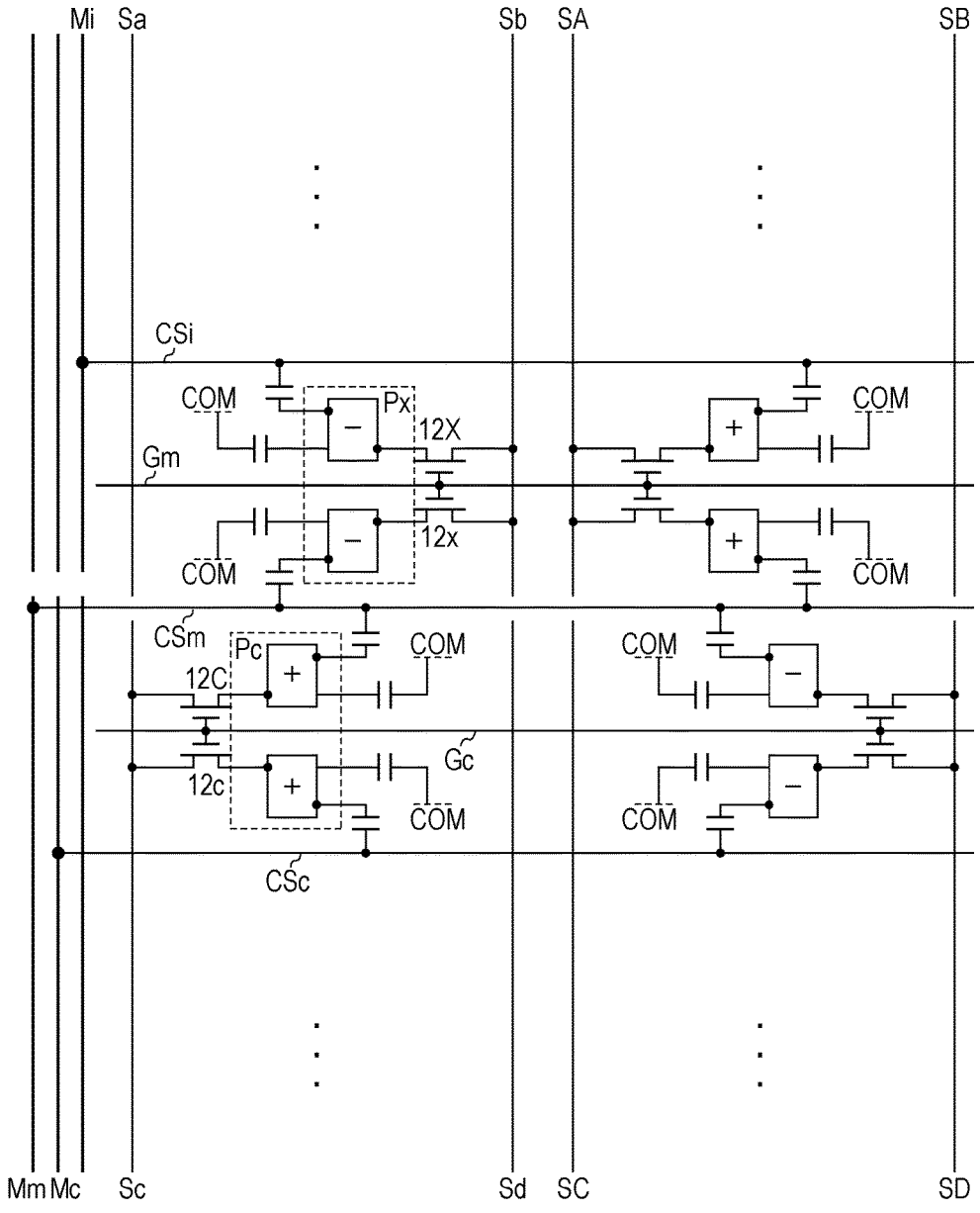
FIG. 12 is a circuit diagram illustrating a distribution of polarities of pixels (portion of FIG. 9) according to the driving method in FIG. 10.
Figure 13:
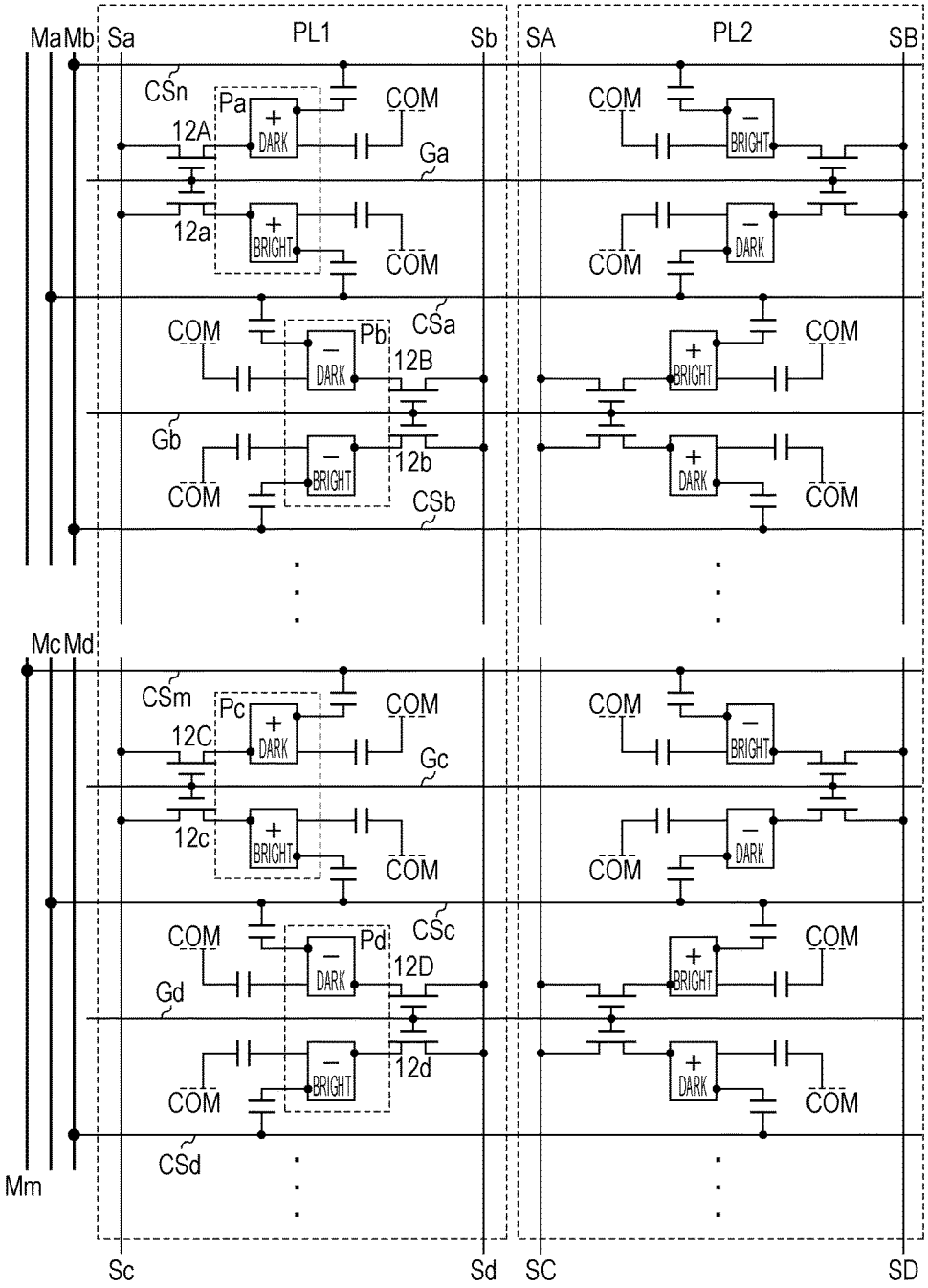
FIG. 13 is a circuit diagram illustrating a distribution of light and shade areas (portion of FIG. 8) according to the driving method in FIG. 10.
Figure 14:
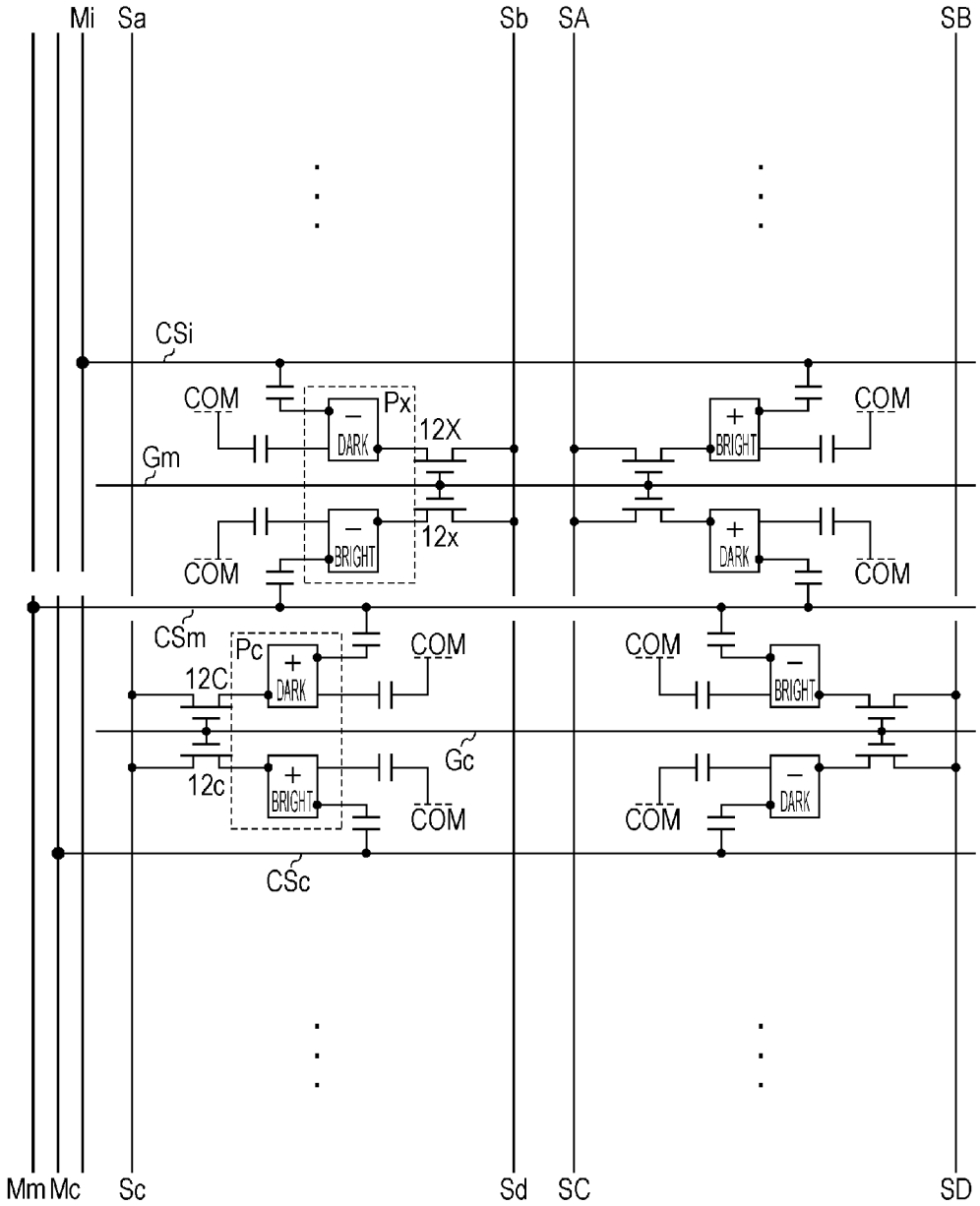
FIG. 14 is a circuit diagram illustrating a distribution of light and shade areas (portion of FIG. 9) according to the driving method in FIG. 10.

A timing chart in FIG. 10 and schematic diagrams in FIGS. 11 to 14 illustrate a method of driving portions of the liquid crystal panel which are illustrated in FIGS. 8 and 9. As illustrated in FIG. 10, positive data signal potentials are supplied to the data signal lines Sa, SA, Sc and SC during a vertical scanning period, and negative data signal potentials are supplied to the data signal lines Sb, SB, Sd and SD during a vertical scanning period.

A simultaneous scanning of the scanning signal lines Ga to Gd is started at a time t0, and the simultaneous scanning of the scanning signal lines Ga to Gd is finished at a time t1 to which 1H (vertical scanning period) elapses from the time t0. Accordingly, a positive data signal potential is applied to the pixel electrodes 17A and 17*a*; a negative data signal potential is applied to the pixel electrodes 17B and 17*b*; a positive data signal potential is applied to the pixel electrodes 17C and 17*c*; and a negative data signal potential is applied to the pixel electrodes 17D and 17*d*.

A modulation signal transmitted from the CS stem wiring Mb shifts an electrical potential of the holding-up capacitance wiring CSn to an L (Low) side at a time t2 to which 1H elapses from the time t1. Accordingly, an electrical potential of the pixel electrode 17A drops, and an effective electrical potential until the next scanning event is decreased more than the applied data signal potential (+) (becomes a dark area). In addition, modulation signals, which are transmitted from the CS drivers CD1 and CD2 via the CS stem wirings Ma and Mc, shift an electrical potential of the holding-up capacitance wiring CSa to an H (High) side at the time t2. Accordingly, an electrical potential of the pixel electrode 17*a* drops, and an effective electrical potential until the next scanning event is increased more than the applied data signal potential (+) (becomes a bright area). In addition, (since the electrical potential of the holding-up capacitance wiring CSa is shifted to an H side) an electrical potential of the pixel electrode 17B drops at the time t2, and an effective electrical potential until the next scanning event is increased more than the applied data signal potential (−) (becomes a dark area).

Furthermore, a modulation signal transmitted from the CS stem wiring Mm shifts an electrical potential of the holding-up capacitance wiring CSm to an L (Low) side at a time t2. Accordingly, an electrical potential of the pixel electrode 17C drops, and an effective electrical potential until the next scanning event is decreased more than the applied data signal potential (+) (becomes a dark area). In addition, modulation signals, which are transmitted from the CS drivers CD3 and CD4 via the CS stem wirings Me and Mg, shift an electrical potential of the holding-up capacitance wiring CSc to an H (High) side at the time t2. Accordingly, an electrical potential of the pixel electrode 17*c* drops, and an effective electrical potential until the next scanning event is increased more than the applied data signal potential (+) (becomes a bright area).

Furthermore, modulation signals, which are transmitted from the CS drivers CD1 and CD2 via the CS stem wirings Mb and Md shift an electrical potential of the holding-up capacitance wiring CSb to an L (Low) side at a time t2. Accordingly, an electrical potential of the pixel electrode 17*b* drops, and an effective electrical potential until the next scanning event is decreased more than the applied data signal potential (−) (becomes a bright area).

When a scanning of the pixel Px, which is positioned at the bottom of the first area, is finished at a time t3, a negative data signal potential is applied to the pixel electrodes 17X and 17*x*. Furthermore, since a modulation signal transmitted from the CS stem wiring Mm shifts an electrical potential of the holding-up capacitance wiring CSm to an L (Low) side at the time t3, an electrical potential of the pixel electrode 17*x* drops, and an effective electrical potential until the next scanning event is decreased more than the applied data signal potential (−) (becomes a bright area).

In four of the scanning signal lines Ga to Gd which are simultaneously selected, when the scanning signal line Ga is an nth line from an upper long side of the panel and the scanning signal line Gb is an n+1th line therefrom (n=0 in the illustrations of FIGS. 8 to 14), the scanning signal line Gc is an n+2160th line from the upper long side of the panel and the scanning signal line Gb is an n+2161th line therefrom. When a data signal of an nth line of an Nth frame is applied to the scanning signal line Ga which is provided in the upper half portion of the panel, a data signal of an n+2160th line of an N−1th frame, which is a frame right before the Nth frame, is applied to the scanning signal line Gc which is provided in the lower half portion of the panel. In this way, displays in the top and bottom portions of the panel are suppressed from being shifted from each other.

The backlight controller BLC receives a video signal QBL output from the pixel mapping circuit PMC and outputs a backlight control signal to a backlight driver BD, and the backlight BL is driven by the backlight driver BD. The backlight BL is divided into a plurality of areas, and a brightness adjustment for each area is independently performed in response to the video signal QBL (active backlight).

A power supply controller monitors levels of electrical power supplied from commercial power supplies which are connected to three power supply circuits, respectively. When an abnormality (decrease in the level of a supplied electrical power) occurs in one or a plurality of the commercial power supplies for any reason, the power supply controller switches a power supply line (for example, three channels for R, B and G) to the backlight BL and power supply lines (for example, one channel) to the display control substrates DC1 to DC4 to one or a plurality of normal commercial power supplies, and the power supply controller outputs an abnormality occurrence signal to the backlight controller BLC. The backlight controller BLC which receives the abnormality occurrence signal outputs a control signal to the backlight driver BD in such a manner that an upper limit of brightness of the backlight BL is lowered. Accordingly, damages to the display control substrates DC1 to DC4, which are caused by unexpected abnormalities in the commercial power supplies, can be avoided.

In a case where it is possible for a configuration not to require three power supply circuits due to electric power saving of a liquid crystal display and have only one power supply circuit which is connected to a commercial power supply, the power supply controller monitors the level of an electrical power supplied from the commercial power supply. When an abnormality (decrease in the level of a supplied electrical power) occurs in the commercial power supply for any reason, the power supply controller can output an abnormality occurrence signal to the backlight controller BLC (the backlight controller BLC which receives the abnormality occurrence signal can output a control signal to the backlight driver BD in such a manner that an upper limit of brightness of the backlight BL is lowered).

Example 2

Figure 5:
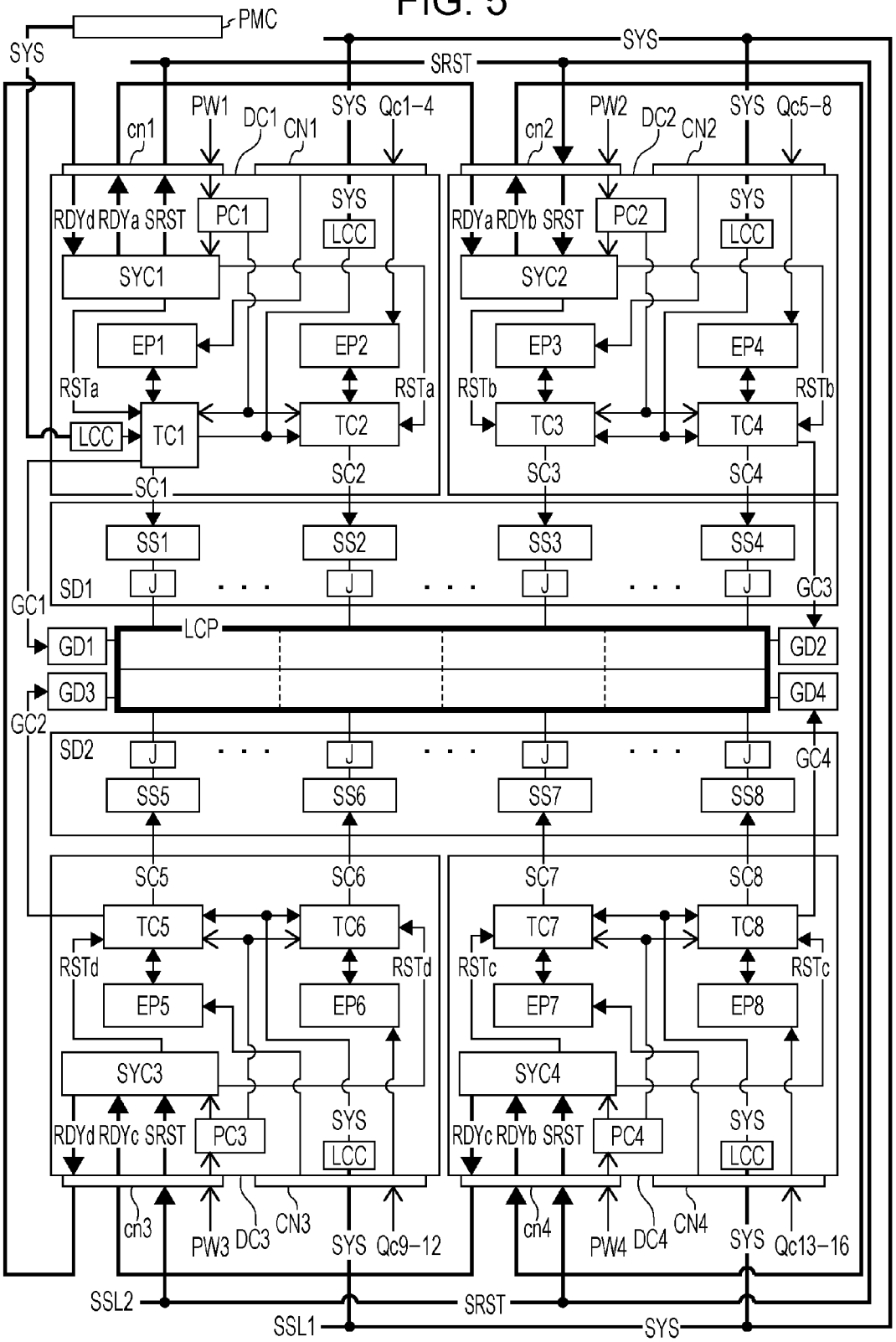
FIG. 5 is a schematic diagram illustrating a configuration of a liquid crystal display according to EXAMPLE 2.
Figure 6:
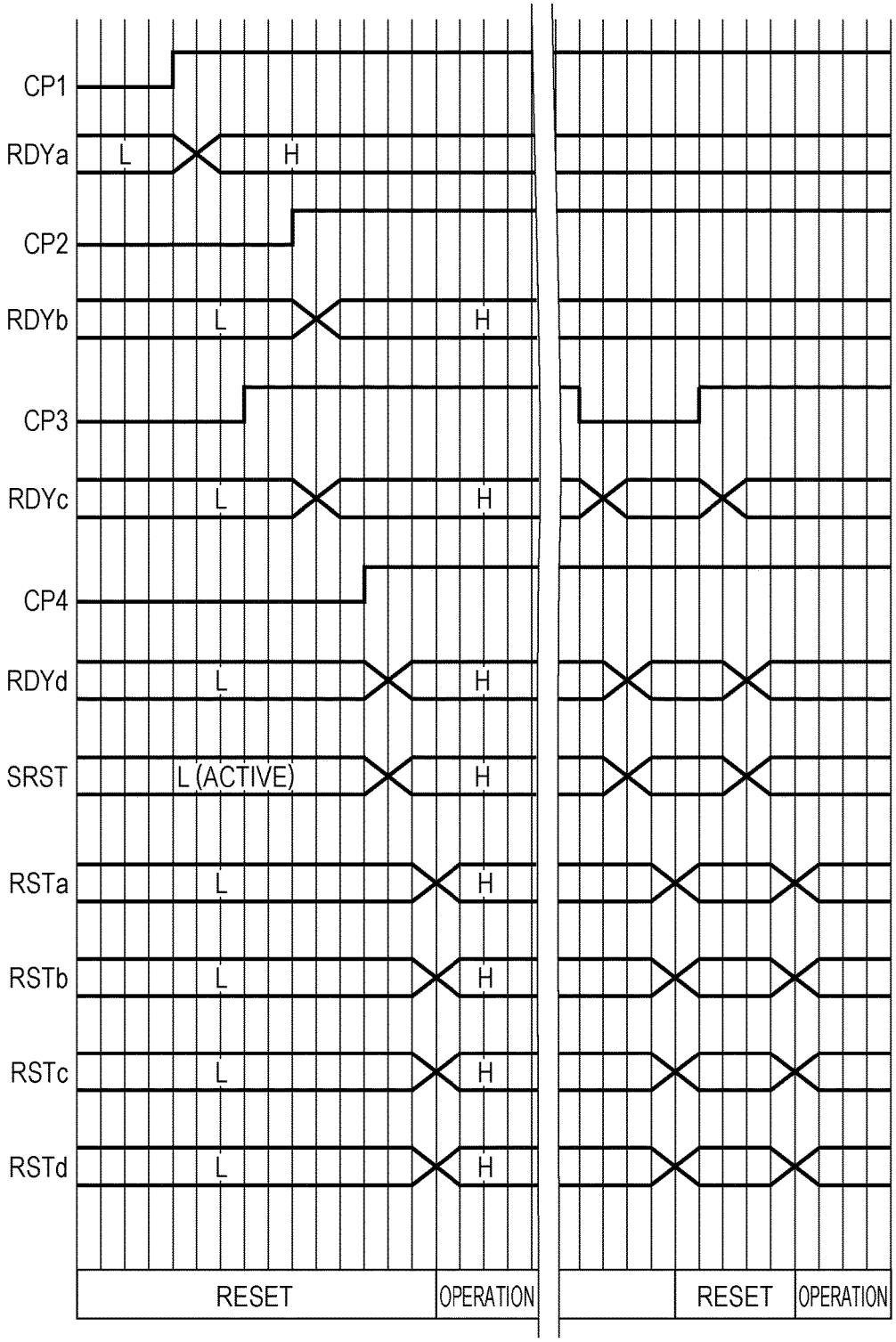
FIG. 6 is a timing chart illustrating an operation of each display control substrate in EXAMPLE 2.

In FIGS. 1, 3 and 4, TTL level signals or CMOS level signals (single-ended signals) are used for the preparation signals RDYa to RDYd, the reset signal SRST and the synchronization signal SYS, but signals for use are not limited to the TTL level signals or CMOS level signals. For example, differential (based) signals such as LVDS can be used for at least one of the preparation signals RDYa to RDYd, the reset signal SRST and the synchronization signal SYS. For example, as illustrated in FIG. 5, differential signals (differential signal paths are illustrated by thick lines in FIG. 5) may be used for all of the preparation signals RDYa to RDYd, the reset signal SRST and the synchronization signal SYS. Since single-ended signals are input to the timing controllers TC to TC8 or the video process circuits EP1 to EP8, conversion circuits LCC are provided in the display control substrates DC1 to DC4 to convert differential signals to single-ended signals.

In this way, even though distances between the display control substrates become long or the reset-purpose shared line SSL 2 or the synchronization-purpose shared line SSL1 becomes long, an influence of noise can be reduced. In addition, even though transmission lines for the preparation signals RDYa to RDYd, the reset signal SRST and the synchronization signal SYS overlap each other, mutual interference can be suppressed.

Example 3

Figure 7:
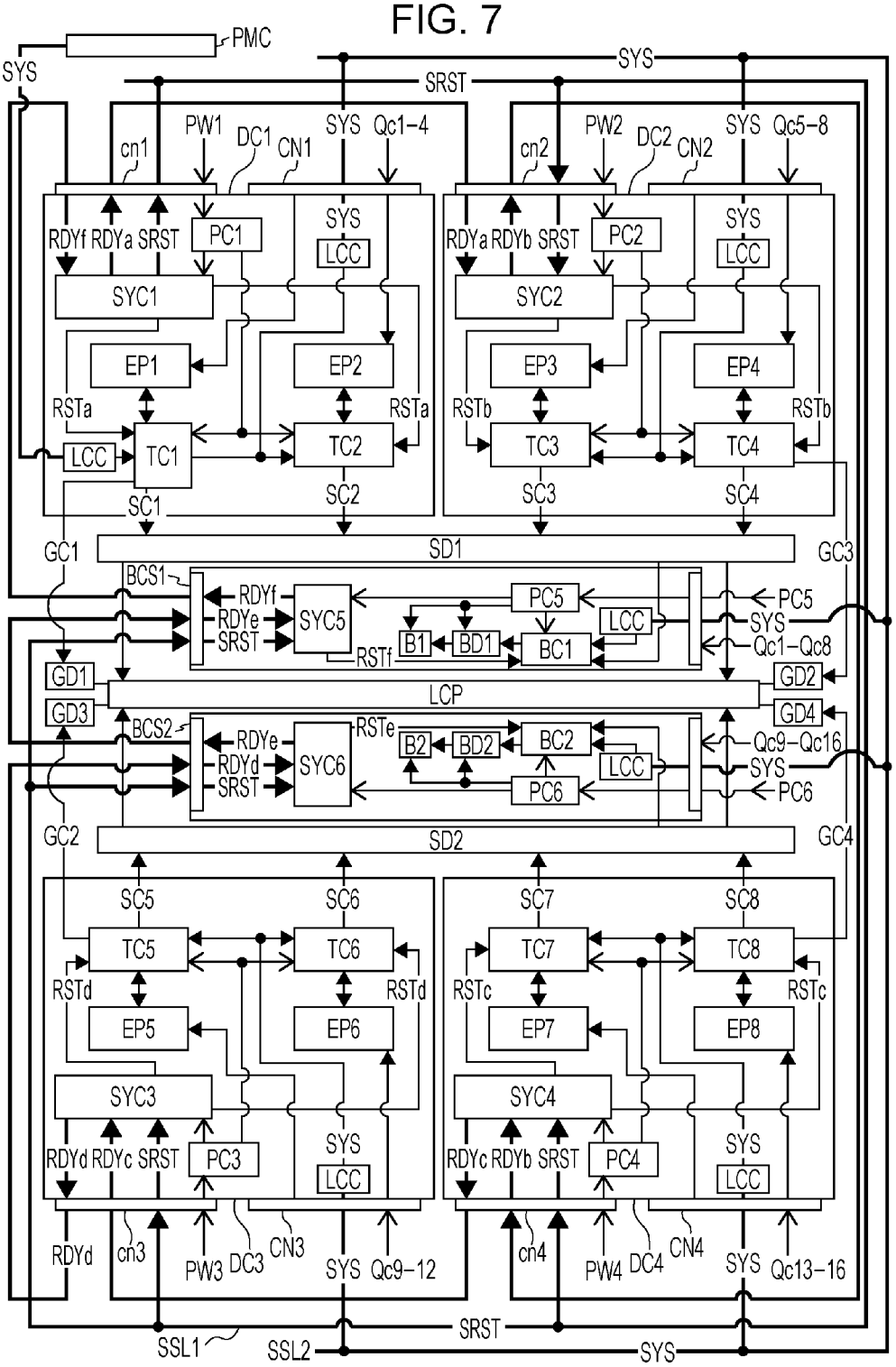
FIG. 7 is a schematic diagram illustrating a configuration of a liquid crystal display according to EXAMPLE 3.

When it is required to synchronize the backlight of the liquid crystal display with driving of the liquid crystal panel (for example, when the liquid crystal display copes with 3D or when the active backlight is adopted), the liquid crystal display in FIG. 5 can be configured to have backlight control substrates BCS1 and BCS2 as illustrated in FIG. 7. That is, a backlight control circuit BC1, a backlight driver BD1 and a backlight B1 are provided in the backlight control substrate BCS1, and a synchronization circuit SYC5, a power supply circuit PC5 and video signals Qc1 to Qc8 are input to the backlight control circuit BC1, the backlight driver BD1 and the backlight B1. A backlight control circuit BC2, a backlight driver BD2 and a backlight B2 are provided in the backlight control substrate BCS2, and a synchronization circuit SYC6, a power supply circuit PC6 and video signals Qc9 to Qc16 are input to the backlight control circuit BC2, the backlight driver BD2 and the backlight B2.

When a power supply voltage signal from the local power supply circuit PC1 is equal to or larger than a threshold level, the synchronization circuit SYC1 sets the preparation signal RDYa to be active (readiness signal) and transmits the active preparation signal RDYa to the synchronization circuit SYC2 via the synchronization connectors cn1 and cn2. When the preparation signal RDYa from the synchronization circuit SYC1 is active and a power supply voltage signal from the local power supply circuit PC2 is equal to or larger than a threshold level, the synchronization circuit SYC2 sets the preparation signal RDYb to be active (readiness signal) and transmits the active preparation signal RDYb to the synchronization circuit SYC4 via the synchronization connectors cn2 and cn4. When the preparation signal RDYb from the synchronization circuit SYC2 is active and a power supply voltage signal from the local power supply circuit PC4 is equal to or larger than a threshold level, the synchronization circuit SYC4 sets the preparation signal RDYc to be active (readiness signal) and transmits the active preparation signal RDYc to the synchronization circuit SYC3 via the synchronization connectors cn4 and cn3. When the preparation signal RDYc from the synchronization circuit SYC4 is active and a power supply voltage signal from the local power supply circuit PC3 is equal to or larger than a threshold level, the synchronization circuit SYC3 sets the preparation signal RDYd to be active (readiness signal) and transmits the active preparation signal RDYd to the synchronization circuit SYC6 via the synchronization connector cn3. When the preparation signal RDYd from the synchronization circuit SYC3 is active and a power supply voltage signal from the local power supply circuit PC6 is equal to or larger than a threshold level, the synchronization circuit SYC6 sets a preparation signal RDYe to be active (readiness signal) and transmits the active preparation signal RDYe to the synchronization circuit SYC5. When a preparation signal RDYe from the synchronization circuit SYC6 is active and a power supply voltage signal from the local power supply circuit PC5 is equal to or larger than a threshold level, the synchronization circuit SYC5 sets a preparation signal RDYf to be active (readiness signal) and transmits the active preparation signal RDYf to the synchronization circuit SYC1 via a synchronization connector.

When the preparation signal RDYf from the synchronization circuit SYC5 becomes active, the synchronization circuit SYC1 sets the reset signal SRST to be inactive (reset release signal) and transmits the inactive reset signal SRST to the reset-purpose shared line SSL2 via the synchronization connector cn1 and to the timing controller TC2. The reset release signal is transmitted to the synchronization circuits SY2 to SYC6 all at once via the reset-purpose shared line SSL2 and the synchronization connectors cn2 to cn4.

The synchronization circuit SYC2 which receives the reset release signal sets the reset release signal RSTb to the timing controllers TC3 and TC4 to be active, and thus, preparations of operations of the timing controllers TC3 and TC4 are completed. In addition, the synchronization circuit SYC4 which receives the reset release signal sets the reset release signal RSTc to the timing controllers TC7 and TC8 to be active, and thus, preparations of operations of the timing controllers TC7 and TC8 are completed. In addition, the synchronization circuit SYC3 which receives the reset release signal sets the reset release signal RSTd to the timing controllers TC5 and TC6 to be active, and thus, preparations of operations of the timing controllers TC5 and TC6 are completed. In addition, the synchronization circuit SYC6 which receives the reset release signal sets a reset release signal RSTe to the backlight control circuit BC2 to be active, and thus, a preparation of an operation of the backlight control circuit BC2 is completed. In addition, the synchronization circuit SYC5 which receives the reset release signal sets a reset release signal RSTf to the backlight control circuit BC1 to be active, and thus, a preparation of an operation of the backlight control circuit BC1 is completed.

For convenience of description, the present invention has four of the display control substrates, but five or more of the display control substrates can be adopted.

As described above, the liquid crystal display includes a liquid crystal panel and the first to nth control substrates (n is an integer which is 2 or greater) which control the liquid crystal panel. When the first control substrate enters an operable status, the first control substrate transmits a readiness signal to the second control substrate which is at the next stage, and when the nth control substrate determines that the nth control substrate receives a readiness signal from a control substrate at the previous stage and is in an operable status, the nth control substrate transmits a readiness signal to the first control substrate.

According to the liquid crystal display, the first control substrate (master) can recognize that other control substrates (slaves) are in readiness, thereby being able to suppress a synchronization failure between the plurality of control substrates which are provided in a liquid crystal display.

In the liquid crystal display, the liquid crystal panel can be configured to contain the first to nth areas in which displays are controlled by the first to nth control substrates, respectively.

The liquid crystal display can have a configuration in which a timing controller is provided on each of the first to nth control substrates and the respective timing controllers are operated in synchronization with each other based on a synchronization signal.

The liquid crystal display can have a configuration in which the first control substrate receives a readiness signal from the nth control substrate and transmits a reset release signal to all of other control substrates.

The liquid crystal display can have a configuration in which, after the first control substrate transmits the reset release signal, the first control substrate transmits the synchronization signal to all of other control substrates.

The liquid crystal display can be configured to provide a power supply circuit on each of the first to nth control substrates.

The liquid crystal display can have a configuration in which the readiness signal is a differential signal.

The liquid crystal display can have a configuration in which the synchronization signal is a differential signal.

The liquid crystal display can have a configuration in which the reset release signal is a differential signal.

The liquid crystal display can have a configuration in which the control substrates other than the first control substrate are provided with synchronization circuits generating a readiness signal for its own stage based on a readiness signal from a control substrate at a previous stage and a supply voltage from a power supply circuit.

The present invention is not limited to the embodiments described herein, and embodiments of the present invention contain other embodiments which are obtained by appropriate modifications to the embodiments based on the common general technical knowledge or from combinations thereof.

INDUSTRIAL APPLICABILITY

The present invention can be applied to a liquid crystal television or a liquid crystal display.

REFERENCE SIGNS LIST

LCD LIQUID CRYSTAL DISPLAY
LCP LIQUID CRYSTAL PANEL
TC1 TO TC8 TIMING CONTROLLER
DC1 TO DC4 DISPLAY CONTROL SUBSTRATE
SYC1 TO SYC4 SYNCHRONIZATION CIRCUIT
PC1 TO PC4 LOCAL POWER SUPPLY CIRCUIT
CN1 TO CN4 VIDEO CONNECTOR
Cn1 TO cn4 SYNCHRONIZATION CONNECTOR
RDYa TO RDYf PREPARATION SIGNAL
SRST RESET SIGNAL
SYS SYNCHRONIZATION SIGNAL
RSTa TO RSTf RESET RELEASE SIGNAL
SSL SUBSTRATE SHARED LINE
SSL1 SYNCHRONIZATION-PURPOSE SHARED LINE
SSL2 RESET-PURPOSE SHARED LINE
Pa TO Pd PIXEL
Ga TO Gd SCANNING SIGNAL LINE
17*a* AND 17A PIXEL ELECTRODE
17*b* AND 17B PIXEL ELECTRODE
12*a* AND 12A TRANSISTOR
12*b* AND 12B TRANSISTOR
Sa TO Sd DATA SIGNAL LINE
SA TO SD DATA SIGNAL LINE
AR1 TO AR4 (LOCAL AREA 1 AND 2) FIRST AREA
AR5 TO AR8 (LOCAL AREA 3 AND 4) SECOND AREA

The invention claimed is:

1. A liquid crystal display comprising:

a liquid crystal panel having n separate display areas wherein n is an integer which is 2 or greater; and first to nth control substrates which control the respective display areas, wherein, when a power supply voltage of the first control substrate becomes equal to or larger than a first threshold, the first control substrate transmits a readiness signal to the second control substrate which is at a next stage, wherein, the nth control substrate transmits a readiness signal to the first control substrate based on the nth control substrate receiving a readiness signal from a control substrate at a previous stage and a power supply voltage of the nth control substrate becoming equal to or larger than an nth threshold, wherein the first control substrate receives a readiness signal from the nth control substrate and transmits a reset release signal to all of other control substrates, wherein reset states of the other control substrates are released in response to the reset release signal, wherein a timing controller is provided on each of the first to nth control substrates and the respective timing controllers are operated in synchronization with each other based on a synchronization signal, and wherein preparations of operations of timing controllers provided on the other control substrates are completed by the reset release signal.

2. The liquid crystal display according to claim 1, wherein the liquid crystal panel contains a first to nth areas in which displays are controlled by the first to nth control substrates, respectively.

3. The liquid crystal display according to claim 1, wherein, after the first control substrate transmits the reset release signal, the first control substrate transmits the synchronization signal to all of other control substrates.

4. The liquid crystal display according to claim 1, wherein a power supply circuit is provided on each of the first to nth control substrates.

5. The liquid crystal display according to claim 4, wherein the control substrates other than the first control substrate are provided with synchronization circuits generating a readiness signal for its own stage based on a readiness signal from a control substrate at a previous stage and a supply voltage from a power supply circuit.

6. The liquid crystal display according to claim 1, wherein the readiness signal is a differential signal.

7. The liquid crystal display according to claim 1, wherein the synchronization signal is a differential signal.

8. The liquid crystal display according to claim 1, wherein the reset release signal is a differential signal.

9. The liquid crystal display according to claim 1, wherein:

two gate drivers driving a same scan signal line are provided;

one of the first to nth control substrates controls one of the two gate drivers; and another of the first to nth control substrates controls another of the two gate drivers.

* * * * *